US012557958B2

(12) United States Patent
Kim et al.

(10) Patent No.: US 12,557,958 B2
(45) Date of Patent: Feb. 24, 2026

(54) ROBOT CLEANER

(71) Applicant: LG ELECTRONICS INC., Seoul (KR)

(72) Inventors: Youngbin Kim, Seoul (KR); Jaewon Jang, Seoul (KR); Minwoo Lee, Seoul (KR); Yeongjae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 545 days.

(21) Appl. No.: 18/016,633

(22) PCT Filed: Jul. 13, 2021

(86) PCT No.: PCT/KR2021/008983
§ 371 (c)(1),
(2) Date: Jan. 17, 2023

(87) PCT Pub. No.: WO2022/015024
PCT Pub. Date: Jan. 20, 2022

(65) Prior Publication Data

US 2023/0284855 A1 Sep. 14, 2023

(30) Foreign Application Priority Data

Jul. 17, 2020 (KR) ..... 10-2020-0088653

(51) Int. Cl.
*A47L 11/282* (2006.01)
*A47L 11/40* (2006.01)

(52) U.S. Cl.
CPC ..... *A47L 11/282* (2013.01); *A47L 11/4005* (2013.01); *A47L 11/4038* (2013.01);
(Continued)

(58) Field of Classification Search
CPC ..... A46B 13/00; A46B 13/02; A46B 13/001; A47L 13/00; A47L 13/10; A47L 13/20;
(Continued)

(56) References Cited

FOREIGN PATENT DOCUMENTS

CN 110251002 9/2019
DE 202016102442 U1 * 6/2016 ..... A47L 11/16
(Continued)

OTHER PUBLICATIONS

International Search Report dated Oct. 21, 2021 issued in Application No. PCT/KR2021/008983.
(Continued)

*Primary Examiner* — C. A. Rivera
(74) *Attorney, Agent, or Firm* — KED & ASSOCIATES, LLP

(57) ABSTRACT

The present disclosure relates to a robot cleaner including: a body including a lower body and an upper body for covering the lower body, the body having a space for accommodating a battery, a water container, and a motor therein; a first rotary plate having a lower portion to which a first mop is coupled; and a second rotary plate having a lower portion to which a second mop is coupled, in which the body includes a bottom surface disposed to be directed toward a floor, and a mop support portion disposed on the bottom surface, protruding downward, and configured to be in contact with the first mop and the second mop, and the mops are bent by being brought into contact with the mop support portion, thereby increasing a frictional force between the floor and the mops.

17 Claims, 19 Drawing Sheets

(52) U.S. Cl.
CPC ..... *A47L 11/4069* (2013.01); *A47L 11/4072* (2013.01); *A47L 11/4083* (2013.01); *A47L 2201/04* (2013.01); *A47L 2201/06* (2013.01)

(58) Field of Classification Search
CPC ..... A47L 13/24; A47L 13/254; A47L 13/255; A47L 13/256; A47L 13/257; A47L 2201/00; A47L 11/00; A47L 11/02; A47L 11/24; A47L 11/28; A47L 11/282; A47L 11/283
See application file for complete search history.

(56) References Cited

FOREIGN PATENT DOCUMENTS

| | | | | | |
|---|---|---|---|---|---|
| JP | 2006-314677 | | | 11/2006 | |
| JP | 3222284 | | | 7/2019 | |
| KR | 20-2002-0034743 | | | 5/2003 | |
| KR | 20-0312080 | | | 5/2003 | |
| KR | 20090047626 | A | * | 5/2009 | ..... A47L 9/22 |
| KR | 20100037469 | A | * | 4/2010 | ..... A47L 11/4038 |
| KR | 20-2014-0006022 | | | 12/2014 | |
| KR | 10-2017-0028764 | | | 3/2017 | |
| KR | 10-1903022 | | | 10/2018 | |
| KR | 10-2019-0015929 | | | 2/2019 | |
| KR | 10-2020-0063259 | | | 6/2020 | |
| KR | 10-2117263 | | | 6/2020 | |
| KR | 20200063259 | A | * | 6/2020 | ..... A47L 11/408 |
| WO | WO 2011-005027 | | | 1/2011 | |

OTHER PUBLICATIONS

International Search Report dated Oct. 21, 2021 issued in Application No. PCT/KR2021/008981.

* cited by examiner

ROBOT CLEANER

CROSS-REFERENCE TO RELATED PATENT APPLICATIONS

This application is a U.S. National Stage Application under 35 U.S.C. § 371 of PCT Application No. PCT/KR2021/008983, filed on Jul. 13, 2021, which claims priority to Korean Patent Application No. 10-2020-0088653, filed Jul. 17, 2020, whose entire disclosures are hereby incorporated by reference.

TECHNICAL FIELD

The present disclosure relates to a robot cleaner, and more particularly, to a robot cleaner capable of rotating a mop of the robot cleaner and moving and cleaning a floor using a frictional force between the mop and the floor.

BACKGROUND ART

Recently, with the development of industrial technologies, a robot cleaner has been developed which performs a cleaning operation while autonomously moving in a zone required to be cleaned without a user's manipulation. Such a robot cleaner has a sensor capable of recognizing a space to be cleaned, and a mop capable of cleaning a floor surface, such that the robot cleaner may move while wiping, with the mop, the floor surface in the space recognized by the sensor.

Among the robot cleaners, there is a wet robot cleaner capable of wiping a floor surface with a mop containing moisture in order to effectively remove foreign substances strongly attached to the floor surface. The wet robot cleaner has a water container and is configured such that water accommodated in the water container is supplied to the mop and the mop containing moisture wipes the floor surface to effectively remove the foreign substances strongly attached to the floor surface.

The mop of the wet robot cleaner has a circular shape and is configured to wipe the floor surface while rotating in a state of being in contact with the floor surface. In addition, the robot cleaner is sometimes configured to move in a particular direction using a frictional force generated when a plurality of mops rotates in a state of being in contact with the floor surface.

Meanwhile, as the frictional force between the mop and the floor surface increases, the mop may strongly wipe the floor surface, such that the robot cleaner may effectively clean the floor surface.

Korean Patent No. 10-1903022 discloses a robot cleaner having a first cleaning module including a left spinning mop and a right spinning mop which are in rotational contact with a floor surface and moves the robot cleaner, and a second cleaning module disposed in front of the first cleaning module.

The left spinning mop and the right spinning mop of the robot cleaner are disposed to be inclined at a predetermined angle with respect to a ground surface.

With this configuration, a portion of the left spinning mop and a portion of the right spinning mop, which are distant from each other, are strongly in contact with the floor. Therefore, the robot cleaner has the effect of wiping the floor while moving the robot cleaner by controlling rotational speeds and rotation directions of the left spinning mop and the right spinning mop.

However, in the case of the robot cleaner, a portion of the left spinning mop and a portion of the right spinning mop, which come into contact with each other, may not come into contact with the floor or the friction is very low even when the portion of the left spinning mop and the portion of the right spinning mop, which are in contact with each other, are in contact with the floor. As a result, there is a problem in that a non-cleaned area may occur.

Meanwhile, Korean Patent Application Laid-Open No. 10-2019-0015929A discloses a robot cleaner that reduces a non-cleaned area.

The robot cleaner moves in a zigzag pattern and performs control so that movement trajectories of spinning mops overlap each other to prevent the occurrence of the non-cleaned area.

The robot cleaner may reduce the non-cleaned area by controlling the movement pattern, but this means that the robot cleaner wipes the existing non-cleaned area again. However, there is a limitation in that the robot cleaner cannot prevent the occurrence of the non-cleaned area.

Therefore, there is a need to develop a structure of a robot cleaner capable of basically reducing the occurrence of the non-cleaned area.

DISCLOSURE

Technical Problem

The present disclosure has been made in an effort to solve the above-mentioned problems of the robot cleaner in the related art, and an object of the present disclosure is to provide a robot cleaner that prevents a mop and a floor from not being in contact with each other at a location adjacent to a center of the robot cleaner.

Another object of the present disclosure is to provide a robot cleaner that increases a frictional force between a mop and a floor at a location adjacent to a center of the robot cleaner.

A further object of the present disclosure is to provide a robot cleaner that improves cleaning performance of a central portion of the robot cleaner.

Technical Solution

In order to achieve the above-mentioned objects, a robot cleaner according to a first embodiment of the present disclosure may include: a body including a lower body and an upper body for covering the lower body, the body having a space for accommodating a battery, a water container, and a motor therein: a first rotary plate having a lower portion to which a first mop facing a floor surface is coupled, the first rotary plate being rotatably disposed on a bottom surface of the lower body; and a second rotary plate having a lower portion to which a second mop facing the floor surface is coupled, the second rotary plate being rotatably disposed on the bottom surface of the lower body.

The lower body may include the bottom surface disposed to be directed toward the floor surface; and a mop support portion disposed on the bottom surface and configured to be in contact with and support the first mop and the second mop.

The mop support portion may include: a coupling surface coupled to the bottom surface: a first mop support surface bent and extending downward from the coupling surface and configured to be in contact with the first mop; and a second mop support surface bent and extending downward from the coupling surface and configured to be in contact with the second mop.

The lower body may further include an imaginary connection line configured to connect a rotary shaft of the first rotary plate and a rotary shaft of the second rotary plate.

The first mop support surface or the second mop support surface may be disposed to be perpendicular to the connection line.

The lower body may further include an imaginary centerline disposed between the first rotary plate and the second rotary plate.

The mop support portion may be disposed on the centerline.

The first rotary plate and the second rotary plate may be disposed symmetrically with respect to the centerline.

In order to achieve the above-mentioned objects, according to a robot cleaner according to a second embodiment of the present disclosure, the mop support portion may include: an extension portion extending by a predetermined angle downward from the bottom surface: a contact support surface configured to be in contact with the first mop and the second mop; and a connection surface configured to connect the extension portion and the contact support surface.

The lower body may further include: an imaginary connection line configured to connect a rotary shaft of the first rotary plate and a rotary shaft of the second rotary plate: a battery accommodation portion disposed at one side based on the connection line and configured to accommodate the battery: an auxiliary wheel disposed at the other side based on the connection line; and an imaginary centerline disposed to be perpendicular to the connection line and configured to connect the battery accommodation portion and the auxiliary wheel.

The extension portion may be disposed between the connection line and the battery accommodation portion.

The connection surface may extend from the extension portion along the centerline.

The mop support portion may further include a guide protrusion protruding and extending from the contact support surface toward the bottom surface.

In order to achieve the above-mentioned objects, according to a robot cleaner according to a third embodiment of the present disclosure, the mop support portion may include: a guide bar disposed on the bottom surface and protruding downward from the bottom surface; and a support bar coupled to be movable along the guide bar and configured to be in contact with the first mop and the second mop.

The mop support portion may further include a spring configured to elastically support the support bar.

The support bar may be disposed on an imaginary connection line configured to connect a rotary shaft of the first rotary plate and a rotary shaft of the second rotary plate.

In order to achieve the above-mentioned objects, according to a robot cleaner according to a fourth embodiment of the present disclosure, the mop support portion may include: a guide bar disposed on the bottom surface and protruding downward from the bottom surface; and a support roller coupled to the guide bar and configured to be in contact with the first mop and the second mop.

The support roller may include: a roller shaft fixedly coupled to the guide bar; a first roller rotatably coupled to the roller shaft and configured to be in contact with the first mop; and a second roller rotatably coupled to the roller shaft and configured to be in contact with the second mop.

The roller shaft may be disposed in parallel with an imaginary connection line configured to connect a rotary shaft of the first rotary plate and a rotary shaft of the second rotary plate.

Advantageous Effect

According to the robot cleaner according to the present disclosure described above, the mop is bent by being brought into contact with the mop support portion, which may increase the area in which the friction is generated with the floor.

In addition, the mop is pushed against the floor by the mop support portion, which may increase the frictional force between the mop and the floor.

In addition, the increase in frictional force between the mop and the floor may improve the cleaning performance of the central portion of the robot cleaner.

MODE FOR INVENTION

Figure 1:
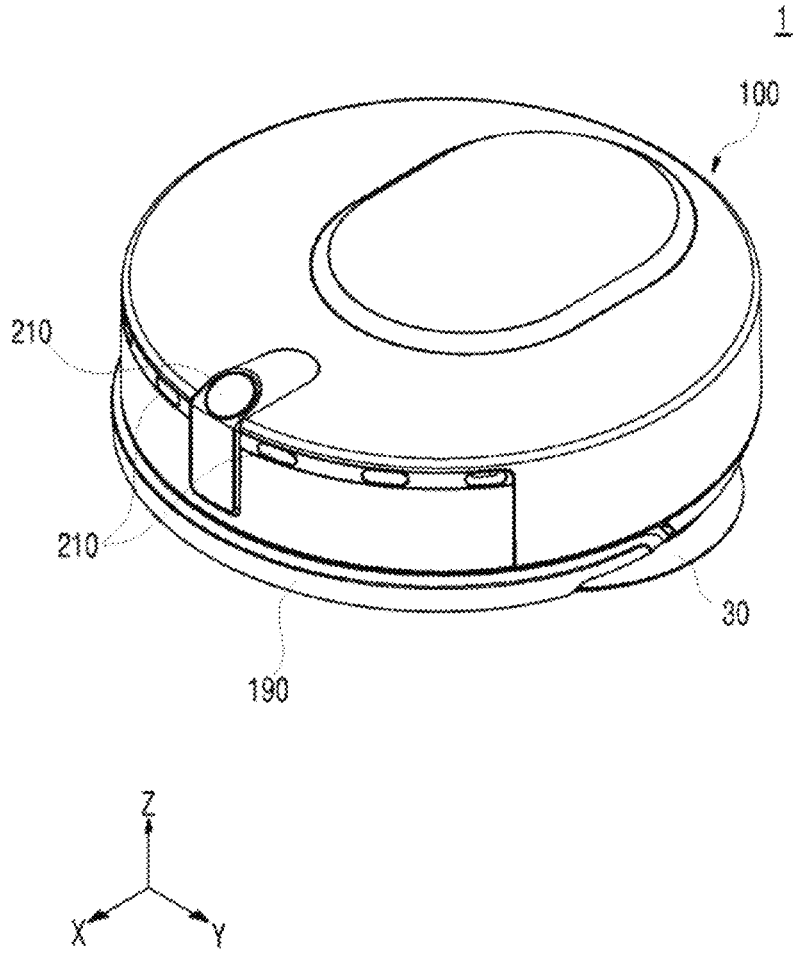
FIG. 1 is a perspective view illustrating a robot cleaner according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

In the description of the present disclosure, the terms such as "first" and "second" may be used to describe various components, but the components should not be limited by the terms. These terms are used only to distinguish one component from another component. For example, a first component may be named a second component, and similarly, the second component may also be named the first component, without departing from the scope of the present disclosure.

The term "and/or" may include any and all combinations of a plurality of the related and listed items.

When one component is described as being "coupled" or "connected" to another component, it should be understood that one component can be coupled or connected directly to another component, and an intervening component can also be present between the components. When one component is described as being "coupled directly to" or "connected directly to" another component, it should be understood that no intervening component is present between the components.

The terms used herein is used for the purpose of describing particular embodiments only and is not intended to limit the present disclosure. Singular expressions may include plural expressions unless clearly described as different meanings in the context.

The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Further, the following embodiments are provided to more completely explain the present disclosure to those skilled in the art, and shapes and sizes of elements illustrated in the drawings may be exaggerated for a more apparent description.

Figure 2:
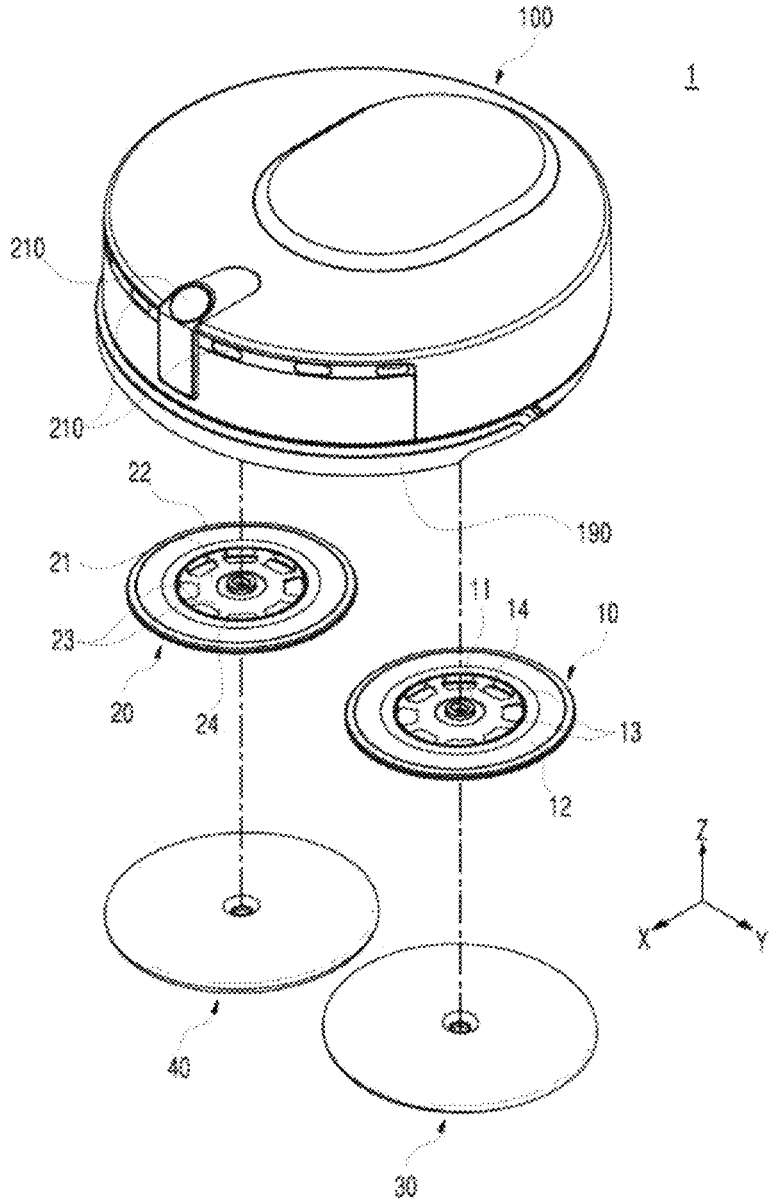
FIG. 2 is a view illustrating some components separated from the robot cleaner illustrated in FIG. 1.
Figure 3:
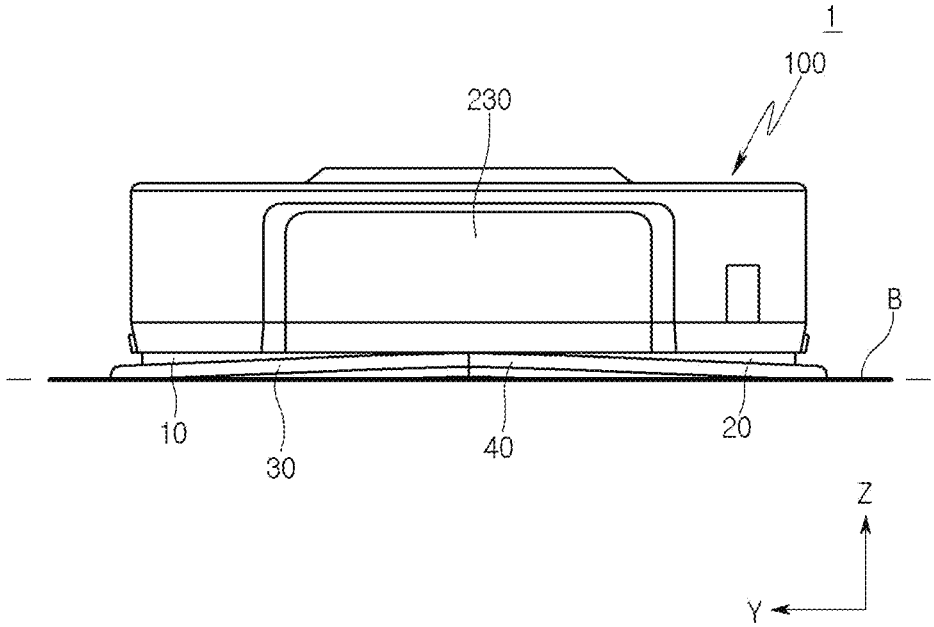
FIG. 3 is a rear view illustrating the robot cleaner illustrated in FIG. 1.
Figure 4:
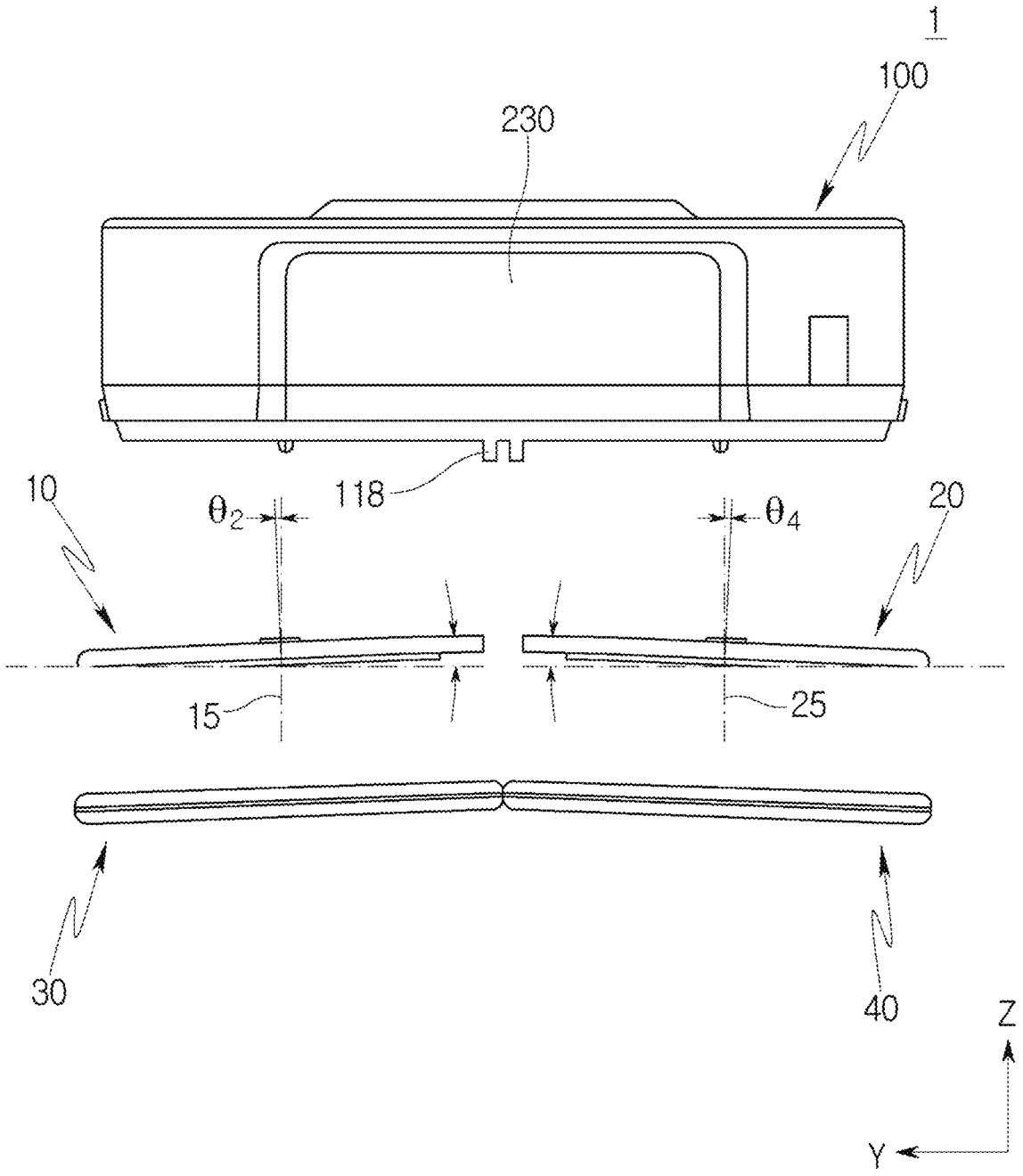
FIG. 4 is a view illustrating some components separated from the robot cleaner illustrated in FIG. 3.
Figure 5:
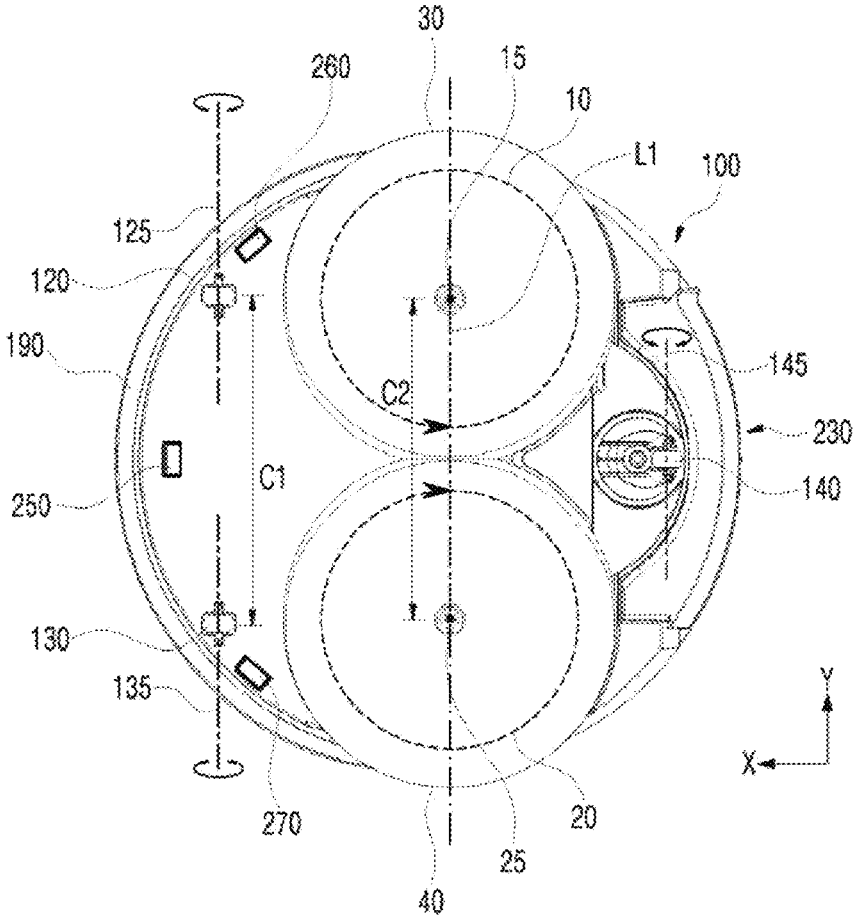
FIG. 5 is a bottom plan view illustrating the robot cleaner according to the embodiment of the present disclosure.
Figure 6:
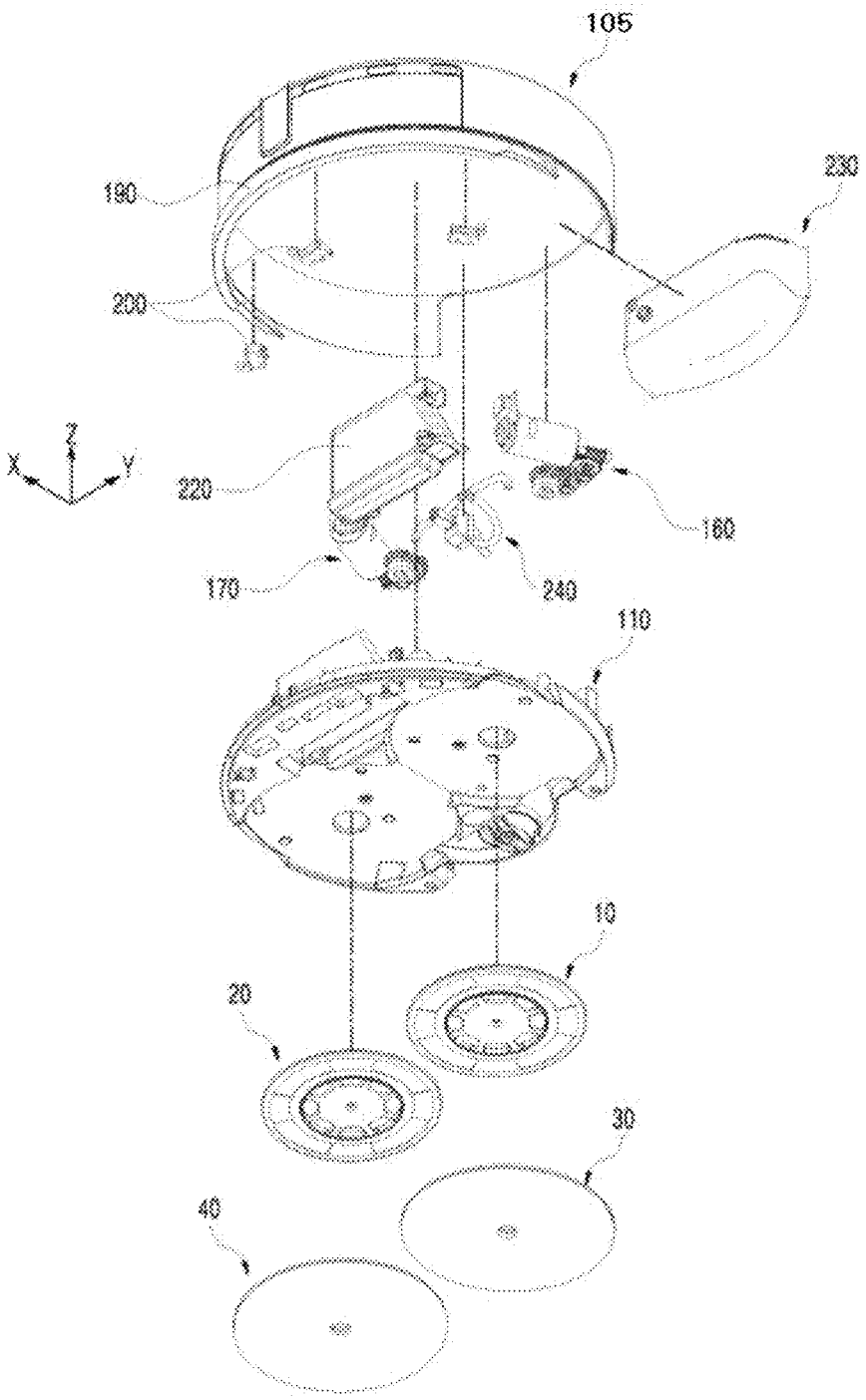
FIG. 6 is an exploded perspective view illustrating the robot cleaner.

FIG. 1 is a perspective view illustrating a robot cleaner 1 according to a first embodiment of the present disclosure, FIG. 2 is a view illustrating some components separated from the robot cleaner 1 illustrated in FIG. 1, FIG. 3 is a rear view illustrating the robot cleaner 1 illustrated in FIG. 1, FIG. 4 is a view illustrating some components separated from the robot cleaner 1 illustrated in FIG. 3, FIG. 5 is a bottom plan view illustrating the robot cleaner 1 according to the embodiment of the present disclosure, and FIG. 6 is an exploded perspective view illustrating the robot cleaner 1.

The robot cleaner 1 according to the embodiment of the present disclosure is configured to be placed on a floor and clean the floor while moving on a floor surface B. Therefore, hereinafter, a vertical direction is defined based on a state in which the robot cleaner 1 is placed on the floor.

Further, a side at which first and second support wheels 120 and 130 to be described below are coupled is defined as a front side based on a first rotary plate 10 and a second rotary plate 20.

Among the portions described in the embodiment of the present disclosure, a 'lowermost portion' may be a portion positioned at a lowest position or a portion closest to the floor when the robot cleaner 1 according to the embodiment of the present disclosure is placed on the floor and used.

The robot cleaner 1 according to the embodiment of the present disclosure includes a body 100, the rotary plates 10 and 20, and mops 30 and 40. In this case, the rotary plates and 20 include the first rotary plate 10 and the second rotary plate 20, and the mops 30 and include a first mop 30 and a second mop 40.

The body 100 may define an entire external shape of the robot cleaner 1 or may be provided in the form of a frame. Components constituting the robot cleaner 1 may be coupled to the body 100, and some of the components constituting the robot cleaner 1 may be accommodated in the body 100.

Specifically, the body 100 may be divided into a lower body 110 and an upper body 105 that covers the lower body 110. The components of the robot cleaner 1 may be provided in a space defined by coupling the lower body 110 and the upper body 105. For example, a battery 220, a water container 230, and motors 162 and 172 may be accommodated in the space in the body 100 (see FIG. 6).

In the embodiment of the present disclosure, a width (or a diameter) in a horizontal direction (i.e., a direction parallel to an X-axis and a Y-axis) of the body 100 may be larger than a height in a vertical direction (i.e., a direction parallel to a Z-axis) of the body 100. The body 100 may provide an advantageous structure that assists the robot cleaner 1 in having a stable structure and allows the robot cleaner 1 to avoid an obstacle while moving traveling.

The body 100 may have various shapes such as a circular shape, an elliptical shape, or a quadrangular shape when viewed from above or below.

The first mop 30 facing the floor may be coupled to a lower portion of the first rotary plate 10, and the first rotary plate 10 may be rotatably disposed on a bottom surface 112 of the lower body 110.

The first rotary plate 10 has a predetermined area and is provided in the form of a flat plate, a flat frame, or the like. The first rotary plate 10 is laid approximately horizontally, such that a width (or a diameter) in the horizontal direction is sufficiently larger than a height in the vertical direction thereof. The first rotary plate 10 coupled to the body 100 may be parallel to the floor surface B or inclined with respect to the floor surface B.

The first rotary plate 10 may be provided in the form of a circular plate, a bottom surface of the first rotary plate 10 may be approximately circular.

The first rotary plate 10 may entirely have a rotationally symmetrical shape.

The first rotary plate 10 may include a first central plate 11, a first outer peripheral plate 12, and first spokes 13.

The first central plate 11 defines a center of the first rotary plate 10 and is rotatably coupled to the body 100. The first central plate 11 may be coupled to the lower portion of the body 100. The first central plate 11 may be coupled to the body 100 in such a way that an upper surface of the first central plate 11 is directed toward the bottom surface of the body 100.

A rotary shaft 15 of the first rotary plate 10 may be provided in a direction that penetrates the center of the first central plate 11. In addition, the rotary shaft 15 of the first rotary plate 10 may be provided in a direction orthogonal to the floor surface B or inclined at a predetermined angle with respect to the direction orthogonal to the floor surface B.

The first outer peripheral plate 12 is spaced apart from the first central plate 11 and disposed to surround the first central plate 11.

The first spokes 13 connect the first central plate 11 and the first outer peripheral plate 12. The first spokes 13 are provided in plural and repeatedly disposed in a circumferential direction of the first central plate 11. The first spokes 13 may be arranged at an equal interval. A plurality of holes 14 penetratively formed in the vertical direction is provided between the first spokes 13, and a liquid (e.g., water) discharged from a water supply tube 240 to be described below may be delivered to the first mop 30 through the holes 14.

In the robot cleaner 1 according to the embodiment of the present disclosure, the bottom surface of the first rotary plate 10 coupled to the body 100 may be inclined at a predetermined angle with respect to the floor surface B. In this case, the rotary shaft 15 of the first rotary plate 10 may be inclined at a predetermined angle with respect to the direction perpendicular to the floor surface B.

In the robot cleaner 1 according to the embodiment of the present disclosure, an angle θ1 defined between the bottom surface of the first rotary plate 10 and the floor surface B may be equal to an angle θ2 defined between the rotary shaft 15 of the first rotary plate 10 and the direction perpendicular to the floor surface B. Therefore, the bottom surface of the first rotary plate 10 may maintain the same angle with respect to the floor surface B when the first rotary plate 10 rotates relative to the body 100.

The second mop 40 facing the floor surface B may be coupled to a lower portion of the second rotary plate 20, and the second rotary plate 20 may be rotatably disposed on the bottom surface 112 of the lower body 110.

The second rotary plate 20 has a predetermined area and is provided in the form of a flat plate, a flat frame, or the like. The second rotary plate 20 is laid approximately horizontally, such that a width (or a diameter) in the horizontal direction is sufficiently larger than a height in the vertical direction thereof. The second rotary plate 20 coupled to the body 100 may be parallel to the floor surface B or inclined with respect to the floor surface B.

The second rotary plate 20 may be provided in the form of a circular plate, a bottom surface of the second rotary plate 20 may be approximately circular.

The second rotary plate 20 may entirely have a rotationally symmetrical shape.

The second rotary plate 20 may include a second central plate 21, a second outer peripheral plate 22, and second spokes 23.

The second central plate 21 defines a center of the second rotary plate 20 and is rotatably coupled to the body 100. The second central plate 21 may be coupled to the lower portion of the body 100. The second central plate 21 may be coupled to the body 100 in such a way that an upper surface of the second central plate 21 is directed toward the bottom surface of the body 100.

A rotary shaft 25 of the second rotary plate 20 may be provided in a direction that penetrates the center of the second central plate 21. In addition, the rotary shaft 25 of the second rotary plate 20 may be provided in a direction orthogonal to the floor surface B or inclined at a predetermined angle with respect to the direction orthogonal to the floor surface B.

The second outer peripheral plate 22 is spaced apart from the second central plate 21 and disposed to surround the second central plate 21.

The second spokes 23 connect the second central plate 21 and the second outer peripheral plate 22. The second spokes 23 are provided in plural and repeatedly disposed in a circumferential direction of the second central plate 21. The second spokes 23 may be arranged at an equal interval. A plurality of holes 24 penetratively formed in the vertical direction is provided between the second spokes 23, and a liquid (e.g., water) discharged from the water supply tube 240 to be described below may be delivered to the second mop 40 through the holes 24.

In the robot cleaner 1 according to the embodiment of the present disclosure, the bottom surface of the second rotary plate 20 coupled to the body 100 may be inclined at a predetermined angle with respect to the floor surface B. In this case, the rotary shaft 25 of the second rotary plate 20 may be inclined at a predetermined angle with respect to the direction perpendicular to the floor surface B.

In the robot cleaner 1 according to the embodiment of the present disclosure, an angle θ3 defined between the bottom surface of the second rotary plate 20 and the floor surface B may be equal to an angle θ4 defined between the rotary shaft 25 of the second rotary plate and the direction perpendicular to the floor surface B. Therefore, the bottom surface of the second rotary plate 20 may maintain the same angle with respect to the floor surface B when the second rotary plate 20 rotates relative to the body 100.

In the robot cleaner 1 according to the embodiment of the present disclosure, the second rotary plate 20 may be identical to the first rotary plate 10 or the second rotary plate 20 and the first rotary plate 10 may be provided symmetrically. When the first rotary plate 10 is positioned at a left side of the robot cleaner 1, the second rotary plate 20 may be positioned at a right side of the robot cleaner 1. In this case, the first rotary plate 10 and the second rotary plate 20 may be vertically symmetric.

A lower surface of the first mop 30, which faces the floor surface B, may have a predetermined area. In addition, the first mop 30 has a flat shape. The first mop 30 is configured such that a width (or a diameter) in the horizontal direction thereof is sufficiently larger than a height in the vertical direction thereof. When the first mop 30 is coupled to the body 100, the lower surface of the first mop 30 may be parallel to the floor surface B or inclined with respect to the floor surface B.

The lower surface of the first mop 30 may be approximately circular.

The first mop 30 may entirely have a rotationally symmetrical shape.

The first mop 30 may be made of various materials capable of wiping the floor surface B while being in contact with the floor surface B. To this end, the lower surface of the first mop 30 may have a woven fabric, a knitted fabric, a non-woven fabric, and/or a brush having a predetermined area.

In the robot cleaner 1 according to the embodiment of the present disclosure, the first mop 30 is attached to or detached from the lower surface of the first rotary plate 10. The first mop 30 is coupled to the first rotary plate 10 and rotates together with the first rotary plate 10. For example, the first mop 30 may be coupled to and in close contact with a bottom surface of the first outer peripheral plate 12 or coupled to and in close contact with a bottom surface of the first central plate 11 and the bottom surface of the first outer peripheral plate 12.

The first mop 30 may be attached to or detached from the first rotary plate 10 by various devices and various methods. For example, at least a part of the first mop 30 may be coupled to the first rotary plate 10 by being caught by or fitted with the first rotary plate 10.

As another example, a separate device such as a clamp may be provided to couple the first mop 30 and the first rotary plate 10.

As still another example, a pair of fastening devices (specific examples of the fastening devices include a pair of magnets configured to apply attractive forces to each other, a pair of Velcro fasteners configured to be coupled to each other, a pair of buttons (a female button and a male button) configured to be coupled to each other, or the like), which is configured to be coupled to or separated from each other, may be provided. One fastening device may be fixed to the first mop 30, and the other fastening device may be fixed to the first rotary plate 10.

When the first mop 30 is coupled to the first rotary plate 10, the first mop 30 and the first rotary plate 10 may be coupled to each other so as to overlap each other. Alternatively, the first mop 30 and the first rotary plate 10 may be coupled to each other in such a way that a center of the first mop 30 is coincident with a center of the first rotary plate 10.

A lower surface of the second mop 40, which is directed toward the floor, may have a predetermined area. In addition, the second mop 40 has a flat shape. The second mop 40 is configured such that a width (or a diameter) in the horizontal direction thereof is sufficiently larger than a height in the vertical direction thereof. When the second mop 40 is coupled to the body 100, the bottom surface of the second mop 40 may be parallel to the floor surface B or inclined with respect to the floor surface B.

The lower surface of the second mop 40 may be approximately circular.

The second mop 40 may entirely have a rotationally symmetrical shape.

The second mop 40 may be made of various materials capable of wiping the floor surface B while being in contact with the floor surface B. To this end, the lower surface of the second mop 40 may have a woven fabric, a knitted fabric, a non-woven fabric, and/or a brush having a predetermined area.

In the robot cleaner 1 according to the embodiment of the present disclosure, the second mop 40 is attached to or detached from the lower surface of the second rotary plate 20. The second mop 40 is coupled to the second rotary plate 20 and rotates together with the second rotary plate 20. For example, the second mop 40 may be coupled to and in close contact with a lower surface of the second outer peripheral plate 22 or coupled to and in close contact with a lower surface of the second central plate 21 and the lower surface of the second outer peripheral plate 22.

The second mop 40 may be attached to or detached from the second rotary plate by various devices and various methods. For example, at least a part of the second mop may be coupled to the second rotary plate 20 by being caught by or fitted with the second rotary plate 20.

As another example, a separate device such as a clamp may be provided to couple the second mop 40 and the second rotary plate 20.

As still another example, a pair of fastening devices (specific examples of the fastening devices include a pair of magnets configured to apply attractive forces to each other, a pair of Velcro fasteners configured to be coupled to each other, a pair of buttons (a female button and a male button) configured to be coupled to each other, or the like), which is configured to be coupled to or separated from each other, may be provided. One fastening device may be fixed to the second mop 40, and the other fastening device may be fixed to the second rotary plate 20.

When the second mop 40 is coupled to the second rotary plate 20, the second mop and the second rotary plate 20 may be coupled to each other so as to overlap each other. Alternatively, the second mop 40 and the second rotary plate 20 may be coupled to each other in such a way that a center of the second mop 40 is coincident with a center of the second rotary plate 20.

The robot cleaner 1 according to the embodiment of the present disclosure may rectilinearly move along the floor surface B. For example, the robot cleaner 1 may rectilinearly move forward (in the X-axis direction) while performing the cleaning operation and may rectilinearly move rearward to avoid an obstacle or a cliff.

In the robot cleaner 1 according to the embodiment of the present disclosure, the first rotary plate 10 and the second rotary plate 20 may be inclined with respect to the floor surface B so that portions of the first and second rotary plates 10 and 20, which are close to each other, are further spaced apart from the floor surface B than portions of the first and second rotary plates 10 and 20, which are distant from each other. That is, the first rotary plate 10 and the second rotary plate 20 are configured such that portions of the first and second rotary plates 10 and 20, which are distant from the center of the robot cleaner 1, are closer to the floor than portions of the first and second rotary plates 10 and 20, which are close to the center of the robot cleaner 1 (see FIGS. 3 and 4).

In this case, the rotary shaft 15 of the first rotary plate 10 may be disposed to be perpendicular to the lower surface of the first rotary plate 10, and the rotary shaft 25 of the second rotary plate 20 may be disposed to be perpendicular to the lower surface of the second rotary plate 20.

When the first mop 30 is coupled to the first rotary plate 10 and the second mop 40 is coupled to the second rotary plate 20, the portions of the first and second mops 30 and 40, which are distant from each other, are more strongly in contact with the floor.

The frictional force is generated between the floor surface B and the lower surface of the first mop 30 when the first rotary plate 10 rotates. In this case, a point at which the frictional force is generated and a direction in which the frictional force is generated deviate from the rotary shaft 15 of the first rotary plate 10, such that the first rotary plate 10 moves relative to the floor surface B. Further, the robot cleaner 1 may move along the floor surface B.

In addition, the frictional force is generated between the floor surface B and the lower surface of the second mop 40 when the second rotary plate 20 rotates. In this case, a point at which the frictional force is generated and a direction in which the frictional force is generated deviate from the rotary shaft 25 of the second rotary plate 20, such that the second rotary plate 20 moves relative to the floor surface B. Further, the robot cleaner 1 may move along the floor surface B.

When the first rotary plate 10 and the second rotary plate 20 rotate in opposite directions at the same velocity, the robot cleaner 1 may move forward or rearward in a straight direction. For example, when the first rotary plate 10 rotates counterclockwise and the second rotary plate 20 rotates clockwise when viewed from above, the robot cleaner 1 may move forward.

When only any one of the first rotary plate 10 and the second rotary plate 20 rotates, the robot cleaner 1 may change the direction thereof and turn.

When a rotational velocity of the first rotary plate 10 and a rotational velocity of the second rotary plate 20 are different from each other or the first rotary plate 10 and the second rotary plate 20 rotate in the same direction, the robot cleaner 1 may move while changing the direction thereof and move in a curved direction.

However, the first mop 30 or the second mop 40 may be spaced apart from the floor surface B at a location at which the first rotary plate 10 and the second rotary plate 20 are disposed close to each other. That is, at the location at which the first mop 30 and the second mop 40 are in contact with each other, the first mop 30 or the second mop 40 is not in contact with the floor surface B or the friction is very low even when the first mop 30 or the second mop 40 is in contact with the floor surface B. As a result, the floor surface B may not be wiped, and the cleaning performance of the robot cleaner 1 may deteriorate.

In order to solve this problem, in the present disclosure, a mop support portion 118 may be provided on the lower body 110 to improve the cleaning performance of the robot cleaner 1.

The specific configuration of the mop support portion 118 will be described below in detail with reference to FIGS. 8 to 10.

The robot cleaner 1 according to the embodiment of the present disclosure includes a first support wheel 120, a second support wheel 130, and a first lower sensor 250.

The first support wheel 120 and the second support wheel 130 may be configured to be in contact with the floor together with the first mop 30 and the second mop 40.

The first support wheel 120 and the second support wheel 130 are spaced apart from each other and may each be provided in the form of a typical wheel. The first support wheel 120 and the second support wheel 130 may be in contact with the floor and move while rolling. Therefore, the robot cleaner 1 may move along the floor surface B.

The first support wheel 120 may be coupled to the bottom surface of the body 100 at a point at which the first rotary plate 10 and the second rotary plate 20 are spaced apart from each other. The second support wheel 130 may also be coupled to the bottom surface of the body 100 at the point at which the first rotary plate 10 and the second rotary plate 20 are spaced apart from each other.

When an imaginary line connecting the center of the first rotary plate 10 and the center of the second rotary plate 20 in the horizontal direction (the direction parallel to the floor surface B) is defined as a connection line L1, the second support wheel 130 and the first support wheel 120 are positioned at the same side based on the connection line L1. In this case, an auxiliary wheel 140 to be described below and the first support wheel 120 are positioned at different sides based on the connection line L1.

An interval between the first support wheel 120 and the second support wheel 130 may be comparatively large in consideration of an overall size of the robot cleaner 1. More specifically, the interval between the first support wheel 120 and the second support wheel 130 may be set to the extent that the first support wheel 120 and the second support wheel 130 may support a part of a load of the robot cleaner 1 and the robot cleaner 1 stands without falling down laterally in a state in which the first support wheel 120 and the second support wheel 130 are placed on the floor surface B (a state in which a rotation axis 125 of the first support wheel 120 and a rotation axis 135 of the second support wheel 130 are parallel to the floor surface B).

The first support wheel 120 may be positioned in front of the first rotary plate 10, and the second support wheel 130 may be positioned in front of the second rotary plate 20.

In the robot cleaner 1 according to the embodiment of the present disclosure, an overall center 105 of gravity may be disposed closer to the first mop 30 and the second mop 40 than are the first support wheel 120 and the second support wheel 130. The first mop 30 and the second mop 40 support a greater proportion of the load of the robot cleaner 1 than the first support wheel 120 and the second support wheel 130.

The first lower sensor 250 is provided at the lower side of the body 100 and configured to detect a relative distance to the floor B. The first lower sensor 250 may be variously configured as long as the first lower sensor 250 may detect the relative distance between the floor surface B and the point at which the first lower sensor 250 is provided.

When the relative distance to the floor surface B (a distance in the vertical direction from the floor surface or a distance in the direction inclined with respect to the floor surface), which is detected by the first lower sensor 250, exceeds a predetermined value or exceeds a predetermined range, this may be a case in which the floor surface is rapidly lowered. Therefore, the first lower sensor 250 may detect a cliff.

The first lower sensor 250 may be an optical sensor and include a light-emitting portion for emitting light, and a light-receiving portion for receiving reflected light. The first lower sensor 250 may be an infrared sensor.

The first lower sensor 250 may be referred to as a cliff sensor.

The first lower sensor 250, the first support wheel 120, and the second support wheel 130 are provided at the same side based on the connection line L1.

The first lower sensor 250 is positioned between the first support wheel 120 and the second support wheel 130 in a peripheral direction of the body 100. In the robot cleaner 1, when the first support wheel 120 is positioned at a relatively left side and the second support wheel 130 is positioned at a relatively right side, the first lower sensor 250 is positioned at an approximately intermediate portion.

The first lower sensor 250 is provided forward from the support wheels 120 and 130.

When the first lower sensor 250 is provided on the lower surface of the body 100, the first lower sensor 250 may be provided at a point sufficiently spaced apart from the first rotary plate 10 and the second rotary plate 20 (and a point sufficiently spaced apart from the first mop 30 and the second mop 40) to allow the first lower sensor 250 to quickly detect a cliff positioned in front of the robot cleaner 1 and to prevent the detection of cliff by the first lower sensor 250 from being hindered by the first mop 30 and the second mop 40. Therefore, the first lower sensor 250 is provided adjacent to a rim of the body 100.

The operation of the robot cleaner 1 according to the embodiment of the present disclosure may be controlled based on the distance detected by the first lower sensor 250. More specifically, the rotation of any one of the first rotary plate 10 and the second rotary plate may be controlled based on the distance detected by the first lower sensor 250. For example, when the distance detected by the first lower sensor 250 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

In the embodiment of the present disclosure, a detection direction of the first lower sensor 250 may be inclined downward toward the rim of the body 100. For example, in the case in which the first lower sensor 250 is an optical sensor, a direction of the light emitted from the first lower sensor 250 may not be perpendicular to the floor surface B but inclined forward.

Therefore, the first lower sensor 250 may detect a cliff positioned in front of the first lower sensor 250 and detect a cliff positioned comparatively in front of the body 100, thereby preventing the robot cleaner 1 from reaching the cliff.

The robot cleaner 1 according to the embodiment of the present disclosure may change the direction thereof to the left or right and move in the curved direction while performing the cleaning operation. In this case, the first mop 30, the second mop 40, the first support wheel 120, and the second support wheel 130 are in contact with the floor and support the load of the robot cleaner 1.

When the robot cleaner 1 moves while changing the direction thereof to the left, the first lower sensor 250 may detect a cliff F before the first support wheel 120 and the second support wheel 130 reach the cliff F, and the first lower sensor 250 may detect the cliff F before the second support wheel 130 at least reaches the cliff F. The load of the robot cleaner 1 is supported by the first mop 30, the second mop 40, the first support wheel 120, and the second support wheel 130 or supported at least by the first mop 30, the second mop 40, and the second support wheel 130 while the first lower sensor 250 detects the cliff F.

When the robot cleaner 1 moves while rotating to the right, the first lower sensor 250 may detect the cliff F before the first support wheel 120 and the second support wheel 130 reach the cliff F, and the first lower sensor 250 may detect the cliff F before the first support wheel 120 at least reaches the cliff F. The load of the robot cleaner 1 is supported by the first mop 30, the second mop 40, the first support wheel 120, and the second support wheel 130 or supported at least by the first mop 30, the second mop 40, and the first support wheel 120 while the first lower sensor 250 detects the cliff F.

As described above, according to the robot cleaner 1 according to the embodiment of the present disclosure, the first lower sensor may detect the cliff F before the first support wheel 120 and the second support wheel 130 reach the cliff F not only when the robot cleaner 1 rectilinearly moves but also when the robot cleaner 1 changes the direction thereof. Therefore, it is possible to prevent the robot cleaner 1 from falling from the cliff F and prevent the robot cleaner 1 from losing the overall balance.

The robot cleaner 1 according to the embodiment of the present disclosure includes a second lower sensor 260 and a third lower sensor 270.

The second lower sensor 260 and the third lower sensor 270 are disposed at the same side as the first support wheel 120 and the second support wheel 130 based on the connection line L1 and provided at the lower side of the body 100. The second lower sensor 260 and the third lower sensor 270 are configured to detect relative distances to the floor B.

When the second lower sensor 260 is provided on the lower surface of the body 100, the second lower sensor 260 is spaced apart from the first mop 30 and the second mop 40 to prevent the detection of the cliff F by the second lower sensor 260 from being hindered by the first mop 30 and the second mop 40. In addition, the second lower sensor 260 may be provided at a point spaced apart outward from the first support wheel 120 or the second support wheel 130 in order to quickly detect the cliff F positioned at the left side or the right side of the robot cleaner 1. The second lower sensor 260 may be provided adjacent to the rim of the body 100.

The second lower sensor 260 may be provided at the opposite side to the first lower sensor 250 based on the first support wheel 120. Therefore, the cliff F positioned at one side of the first support wheel 120 may be detected by the first lower sensor 250, and the cliff F positioned at the other side of the first support wheel 120 may be detected by the second lower sensor 260, such that the cliff F positioned at the periphery of the first support wheel 120 may be effectively detected.

When the third lower sensor 270 is provided on the lower surface of the body 100, the third lower sensor 270 is spaced apart from the first mop 30 and the second mop 40 to prevent the detection of the cliff F by the third lower sensor 270 from being hindered by the first mop 30 and the second mop 40. In addition, the third lower sensor 270 may be provided at a point spaced apart outward from the first support wheel 120 or the second support wheel 130 in order to quickly detect the cliff F positioned at the left side or the right side of the robot cleaner 1. The third lower sensor 260 may be provided adjacent to the rim of the body 100.

The third lower sensor 270 may be provided at the opposite side to the first lower sensor 250 based on the second support wheel 130. Therefore, the cliff F positioned at one side of the second support wheel 130 may be detected by the first lower sensor 250, and the cliff F positioned at the other side of the second support wheel 130 may be detected by the third lower sensor 270, such that the cliff F positioned at the periphery of the second support wheel 130 may be effectively detected.

The second lower sensor 260 and the third lower sensor 270 may be variously configured as long as the second lower sensor 260 and the third lower sensor 270 may each detect the relative distance to the floor surface B. The second lower sensor 260 and the third lower sensor 270 may be identical to the first lower sensor 250 except for the positions at which the sensors are provided.

The operation of the robot cleaner 1 according to the embodiment of the present disclosure may be controlled based on the distance detected by the second lower sensor 260. More specifically, the rotation of any one of the first rotary plate 10 and the second rotary plate may be controlled based on the distance detected by the second lower sensor 260. For example, when the distance detected by the second lower sensor 260 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

In addition, the operation of the robot cleaner 1 according to the embodiment of the present disclosure may be controlled based on the distance detected by the third lower sensor 270. More specifically, the rotation of any one of the first rotary plate 10 and the second rotary plate 20 may be controlled based on the distance detected by the third lower sensor 270. For example, when the distance detected by the third lower sensor 270 exceeds a predetermined value or a predetermined range, the rotations of the first and second rotary plates 10 and 20 are stopped such that the robot cleaner 1 may be stopped, or the rotation directions of the first rotary plate 10 and/or the second rotary plate 20 are changed such that the movement direction of the robot cleaner 1 may be changed.

A distance from the connection line L1 to the second lower sensor 260 and a distance from the connection line L1 to the third lower sensor 270 may be shorter than a distance from the connection line L1 to the first support wheel 120 and a distance from the connection line L1 to the second support wheel 130.

In addition, the second lower sensor 260 and the third lower sensor 270 are positioned outside a vertical region of a quadrangle having vertices defined by a center of the first rotary plate 10, a center of the second rotary plate 20, a center of the first support wheel 120, and a center of the second support wheel 130.

When the second lower sensor 260 is positioned at the left side of the robot cleaner 1, the third lower sensor 270 may be positioned at the right side of the robot cleaner 1.

The second lower sensor 260 and the third lower sensor 270 may be symmetric to each other.

The robot cleaner 1 according to the embodiment of the present disclosure may turn. In this case, the first mop 30, the second mop 40, the first support wheel 120, and the second support wheel 130 are in contact with the floor and support the load of the robot cleaner 1.

When the cliff F is positioned at the left side of the robot cleaner 1 and the robot cleaner 1 turns or changes the direction thereof to the left, the second lower sensor 260 may detect the cliff F before the first support wheel 120 and the second support wheel 130 reach the cliff F. The load of the robot cleaner 1 is supported by the first mop 30, the second mop 40, the first support wheel 120, and the second support wheel 130 while the second lower sensor 260 detects the cliff F.

In addition, when the cliff F is positioned at the right side of the robot cleaner 1 and the robot cleaner 1 turns or changes the direction thereof to the right, the third lower sensor 270 may detect the cliff F before the first support wheel 120 and the second support wheel 130 reach the cliff F. The load of the robot cleaner 1 is supported by the first mop 30, the second mop 40, the first support wheel 120, and the second support wheel 130 while the third lower sensor 270 detects the cliff F.

As described above, according to the robot cleaner 1 according to the embodiment of the present disclosure, it is possible to prevent the robot cleaner 1 from falling from the cliff F and prevent the robot cleaner 1 from losing the overall balance when the robot cleaner 1 changes the direction thereof or rotates to one side.

The robot cleaner 1 according to the embodiment of the present disclosure may include the auxiliary wheel 140 together with the first support wheel 120 and the second support wheel 130.

The auxiliary wheel 140 may be coupled to the lower portion of the body 100 and spaced apart from the first rotary plate 10 and the second rotary plate 20.

The auxiliary wheel 140 is positioned at a different side from the first support wheel 120 and the second support wheel 130 based on the connection line L1.

In the embodiment of the present disclosure, the auxiliary wheel 140 may be provided in the form of a typical wheel, and a rotation axis 145 of the auxiliary wheel 140 may be parallel to the floor surface B. The auxiliary wheel 140 may be in contact with the floor and move while rolling. Therefore, the robot cleaner may move along the floor surface B.

However, in the embodiment of the present disclosure, the auxiliary wheel 140 is not in contact with the floor when the first mop 30 and the second mop 40 are in contact with the floor.

Based on the first rotary plate 10 and the second rotary plate 20, the first support wheel 120 and the second support wheel 130 are positioned at the front side, and the auxiliary wheel 140 is positioned at the rear side.

In the robot cleaner 1 according to the embodiment of the present disclosure, the first rotary plate 10 and the second rotary plate 20 may be symmetric (vertically symmetric) to each other, and the first support wheel 120 and the second support wheel 130 may be symmetric (vertically symmetric) to each other.

In the robot cleaner 1 according to the embodiment of the present disclosure, in the state in which the first mop 30 is coupled to the first rotary plate 10 and the second mop 40 is coupled to the second rotary plate 20, the first support wheel 120, the second support wheel 130, and the auxiliary wheel 140 do not hinder the contact between the floor and the first and second mops 30 and 40.

Therefore, the first mop 30 and the second mop 40 are in contact with the floor, such that the mopping and cleaning operation may be performed by the rotations of the first and second mops 30 and 40. In this case, all the first support wheel 120, the second support wheel 130, and the auxiliary wheel 140 may be spaced apart from the floor. Alternately, the auxiliary wheel 140 may be spaced apart from the floor, and the first support wheel 120 and the second support wheel 130 may be in contact with the floor.

In the embodiment of the present disclosure, in the state in which the robot cleaner 1 is placed on the floor so that the first mop 30 and the second mop 40 are in contact with the floor, a height from the floor surface B to the lowest portion of the first support wheel 120 and a height from the floor surface B to the lowest portion of the second support wheel 130 may be smaller than a height from the floor surface B to the lowest portion of the auxiliary wheel 140.

The robot cleaner 1 according to the embodiment of the present disclosure includes a first actuator 160, a second actuator 170, the battery 220, the water container 230, and the water supply tube 240.

The first actuator 160 is coupled to the body 100 and configured to rotate the first rotary plate 10.

The first actuator 160 may include a first casing 161, a first motor 162, and one or more first gears 163.

The first casing 161 is fixedly coupled to the body 100 and supports components constituting the first actuator 160.

The first motor 162 may be an electric motor.

The plurality of first gears 163 meshes with each other and rotates together. The plurality of first gears 163 connects the first motor 162 and the first rotary plate 10 and transmits rotational power from the first motor 162 to the first rotary plate 10. Therefore, the first rotary plate 10 rotates when a rotary shaft of the first motor 162 rotates.

The second actuator 170 is coupled to the body 100 and configured to rotate the second rotary plate 20.

The second actuator 170 may include a second casing 171, a second motor 172, and one or more second gears 173.

The second casing 171 is fixedly coupled to the body 100 and supports components constituting the second actuator 170.

The second motor 172 may be an electric motor.

The plurality of second gears 173 meshes with each other and rotates together.

The plurality of second gears 173 connects the second motor 172 and the second rotary plate and transmits rotational power from the second motor 172 to the second rotary plate 20. Therefore, the second rotary plate 20 rotates when a rotary shaft of the second motor 172 rotates.

As described above, in the robot cleaner 1 according to the embodiment of the present disclosure, the first rotary plate 10 and the first mop 30 may be rotated by the operation of the first actuator 160, and the second rotary plate 20 and the second mop 40 may be rotated by the operation of the second actuator 170.

In the embodiment of the present disclosure, the first actuator 160 may be disposed directly on the first rotary plate 10. This configuration may minimize a loss of power transmitted from the first actuator 160 to the first rotary plate 10. In addition, a load of the first actuator 160 may be applied to the first rotary plate 10, such that the first mop 30 may perform the mopping operation while generating sufficient friction with the floor.

In addition, in the embodiment of the present disclosure, the second actuator 170 may be disposed directly on the second rotary plate 20. This configuration may minimize a loss of power transmitted from the second actuator 170 to the second rotary plate 20. In addition, a load of the second actuator 170 may be applied to the second rotary plate 20, such that the second mop 40 may perform the mopping operation while generating sufficient friction with the floor.

The second actuator 170 and the first actuator 160 may be symmetric (vertically symmetric).

The battery 220 is coupled to the body 100 and configured to supply power to the other components constituting the robot cleaner 1. The battery 220 may supply power to the first actuator 160 and the second actuator 170. In particular, the battery 220 supplies power to the first motor 162 and the second motor 172.

In the embodiment of the present disclosure, the battery 220 may be charged with external power. To this end, a charging terminal for charging the battery 220 may be provided at one side of the body 100 or provided on the battery 220.

In the robot cleaner 1 according to the embodiment of the present disclosure, the battery 220 may be coupled to the body 100.

The water container 230 is provided in the form of a container having an internal space that stores therein a liquid such as water. The water container 230 may be fixedly coupled to the body 100 or detachably coupled to the body 100.

In the embodiment of the present disclosure, the water container 230 may be positioned above the auxiliary wheel 140.

The water supply tube 240 is provided in the form of a tube or a pipe and connected to the water container 230 so that the liquid in the water container 230 may flow through the inside of the water supply tube 240. An end of the water supply tube 240, which is opposite to the side at which the water supply tube 240 is connected to the water container 230, is provided above the first rotary plate 10 and the second rotary plate 20, such that the liquid in the water container 230 may be supplied to the first mop 30 and the second mop 40.

In the robot cleaner 1 according to the embodiment of the present disclosure, the water supply tube 240 may be provided in a shape having two tube portions diverged from a single tube portion. In this case, an end of one diverged tube portion may be positioned above the first rotary plate 10, and an end of the other diverged tube portion may be positioned above the second rotary plate 20.

In the robot cleaner 1 according to the embodiment of the present disclosure, a separate pump may be provided to move the liquid through the water supply tube 240.

The center 105 of gravity of the robot cleaner 1 may be positioned in the vertical region of the quadrangle having the vertices defined by the center of the first rotary plate 10, the center of the second rotary plate 20, the center of the first support wheel 120, and the center of the second support wheel 130. Therefore, the robot cleaner 1 is supported by the first mop 30, the second mop 40, the first support wheel 120, and the second support wheel 130.

In the robot cleaner 1 according to the embodiment of the present disclosure, the first actuator 160, the second actuator 170, the battery 220, and the water container 230 may each serve as a comparatively heavyweight member in the robot cleaner 1. Therefore, the overall center 105 of gravity of the robot cleaner 1 may be positioned at the central portion of the robot cleaner 1 as the first actuator 160 and the second actuator 170 are positioned on or adjacent to the connection line, the battery 220 is positioned at the front side of the connection line, and the water container 230 is positioned at the rear side of the connection line. Therefore, the first mop 30 and the second mop 40 may be in stable contact with the floor.

In addition, since the first actuator 160, the second actuator 170, the battery 220, and the water container 230 are positioned in different regions, respectively, in a top plan view, the weight distribution may be stably performed, such that the body 100 and the robot cleaner 1 may become comparatively flat. Therefore, the robot cleaner 1 may be configured to easily enter a lower space of a shelf, a table, or the like.

In addition, according to the robot cleaner 1 according to the embodiment of the present disclosure, the weight distribution may be performed in such a way that only the first mop 30 and the second mop 40 are in contact with the floor and clean the floor when the robot cleaner 1 initially operates with the water container 230 sufficiently filled with the liquid. When the center of gravity of the robot cleaner 1 is moved forward as the liquid in the water container 230 is used, the first mop 30 and the second mop 40, together with the first support wheel 120 and the second support wheel 130, may be in contact with the floor and clean the floor.

In addition, according to the robot cleaner 1 according to the embodiment of the present disclosure, the first support wheel 120 and the second support wheel 130, together with the first mop 30 and the second mop 40, may be in contact with the floor and clean the floor regardless of whether the liquid in the water container 230 is used.

The robot cleaner 1 according to the embodiment of the present disclosure may be configured such that the second lower sensor 260, the first support wheel 120, the first lower sensor 250, the second support wheel 130, and the third lower sensor 270 are arranged in this order in the peripheral direction of the body 100.

Figure 7:
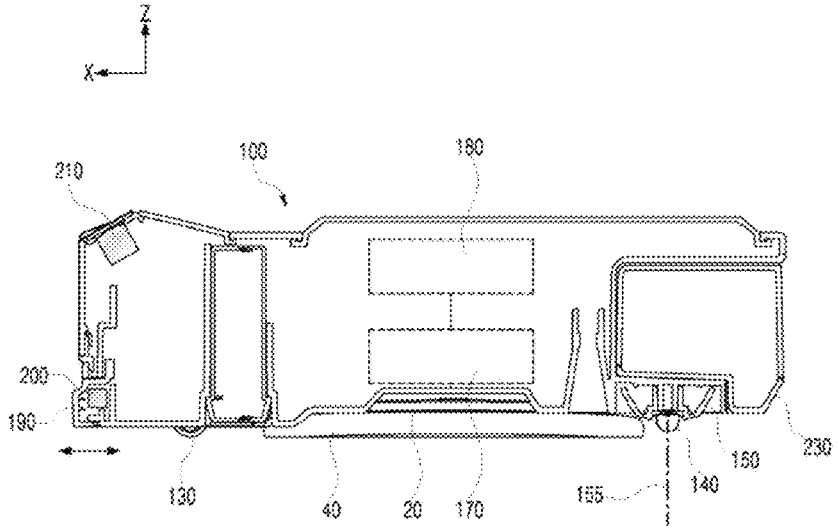
FIG. 7 is a cross-sectional view schematically illustrating the robot cleaner and components of the robot cleaner according to the embodiment of the present disclosure.

FIG. 7 is a cross-sectional view schematically illustrating the robot cleaner 1 and components of the robot cleaner 1 according to still another embodiment of the present disclosure.

The robot cleaner 1 according to the embodiment of the present disclosure may include a control part 180, a bumper 190, a first sensor 200, and a second sensor 210.

The control part 180 may be configured to control the operations of the first and second actuators 160 and 170 based on preset information or real-time information. The robot cleaner 1 may be provided with a storage medium that stores an application program for the control operation of the control part 180. The control part 180 may be configured to control the robot cleaner 1 by executing the application program based on information inputted to the robot cleaner 1 and information outputted from the robot cleaner 1.

The bumper 190 is coupled along the rim of the body 100 and configured to move relative to the body 100. For example, the bumper 190 may be coupled to the body 100 so as to be reciprocally movable in a direction toward the center of the body 100.

The bumper 190 may be coupled along a part of the rim of the body 100 or coupled along the entire rim of the body 100.

In the robot cleaner according to the embodiment of the present disclosure, the lowest portion of the body 100, which is disposed at the same side as the bumper 190 based on the connection line L1, may be equal to or higher in height than the lowest portion of the bumper 190. That is, the bumper 190 may be equal to or lower in height than the body 100. Therefore, an obstacle positioned at a comparatively low position may collide with the bumper 190, and the bumper 190 may detect the obstacle.

The first sensor 200 may be coupled to the body 100 and configured to detect a motion (relative movement) of the bumper 190 relative to the body 100. The first sensor 200 may be a microswitch, a photo-interrupter, a tact switch, or the like.

When the bumper 190 of the robot cleaner 1 comes into contact with an obstacle, the control part 180 may control the robot cleaner 1 to allow the robot cleaner 1 to avoid the obstacle. The control part 180 may control the operation of the first actuator 160 and/or the second actuator 170 based on information detected by the first sensor 200. For example, when the bumper 190 comes into contact with an obstacle while the robot cleaner 1 moves, the first sensor 121 may recognize a position at which the bumper 190 comes into contact with the obstacle, and the control part 180 may control the operations of the first actuator 160 and/or the second actuator 170 so that the robot cleaner 1 departs from the contact position.

The second sensor 210 may be coupled to the body 100 and configured to detect a relative distance to an obstacle. The second sensor 210 may be a distance sensor.

When a distance between the robot cleaner 1 and the obstacle is a predetermined value or less based on information detected by the second sensor 210, the control part 180 may control the operations of the first actuator 160 and/or the second actuator 170 so that the movement direction of the robot cleaner 1 is changed or the robot cleaner 1 moves away from the obstacle.

In addition, based on a distance detected by the first lower sensor 250, the second lower sensor 260, or the third lower sensor 270, the control part 180 may control the operations of the first actuator 160 and/or the second actuator 170 so that the robot cleaner 1 is stopped or the movement direction is changed.

The robot cleaner 1 according to the embodiment of the present disclosure may move (travel) by means of a frictional force generated between the first mop 30 and the floor surface B when the first rotary plate 10 rotates and a frictional force generated between the second mop 40 and the floor surface B when the second rotary plate 20 rotates.

In the robot cleaner 1 according to the embodiment of the present disclosure, the first support wheel 120 and the second support wheel 130 may be configured so as not to hinder the movement (traveling) of the robot cleaner 1 by the frictional force with the floor. Further, the first support wheel 120 and the second support wheel 130 may be configured so as not to increase a load when the robot cleaner 1 moves (travels).

To this end, a width of the first support wheel 120 and a width of the second support wheel 130 may be sufficiently smaller than a diameter of the first rotary plate 10 or a diameter of the second rotary plate 20.

With the above-mentioned configuration, even when the first support wheel 120 and the second support wheel 130, together with the first mop 30 and the second mop 40, are in contact with the floor and the robot cleaner 1 operates, the frictional force between the first support wheel 120 and the floor surface B and the frictional force between the second support wheel 130 and the floor surface B are significantly lower than the frictional force between the first mop 30 and the floor surface B and the frictional force between the second mop 40 and the floor surface B. Therefore, an unnecessary loss of power does not occur, and the movement of the robot cleaner 1 is not hindered.

The robot cleaner 1 according to the embodiment of the present disclosure may be stably supported at four points by the first support wheel 120, the second support wheel 130, the first mop 30, and the second mop 40.

In the robot cleaner 1 according to the embodiment of the present disclosure, the rotation axis 125 of the first support wheel 120 and the rotation axis 135 of the second support wheel 130 may be parallel to the connection line L1. That is, the rotation axis 125 of the first support wheel 120 and the rotation axis 135 of the second support wheel 130 may be fixed (fixed in a left-right direction) in position on the body 100.

The first support wheel 120 and the second support wheel 130, together with the first mop 30 and the second mop 40, may be in contact with the floor. In this case, in order to rectilinearly move the robot cleaner 1, the first mop 30 and the second mop 40 may rotate in opposite directions at the same velocity, and the first support wheel 120 and the second support wheel 130 assist the forward and rearward rectilinear movements of the robot cleaner 1.

The robot cleaner 1 according to the embodiment of the present disclosure may include an auxiliary wheel body 150. In this case, the auxiliary wheel body 150 is rotatably coupled to the lower portion of the body 100, and the auxiliary wheel 140 is rotatably coupled to the auxiliary wheel body 150.

That is, the auxiliary wheel 140 is connected to the body 100 through the auxiliary wheel body 150.

Further, the rotation axis 145 of the auxiliary wheel 140 and the rotation axis 155 of the auxiliary wheel body 150 may intersect each other, and a direction of the rotation axis 145 of the auxiliary wheel 140 may be orthogonal to a direction of the rotation axis 155 of the auxiliary wheel body 150. For example, a rotation axis 155 of the auxiliary wheel body 150 may extend in the vertical direction or may be slightly inclined with respect to the vertical direction. The rotation axis 145 of the auxiliary wheel 140 may extend in the horizontal direction.

In the robot cleaner 1 according to the embodiment of the present disclosure, the auxiliary wheel 140 is in contact with the floor surface B when the robot cleaner 1 is not substantially used (in a state in which the first mop 30 and the second mop 40 are separated from the robot cleaner 1). When the robot cleaner 1 is intended to be moved in this state, a direction in which the auxiliary wheel 140 is directed is freely changed by the auxiliary wheel body 150, such that the robot cleaner 1 may be easily moved.

Figure 8:
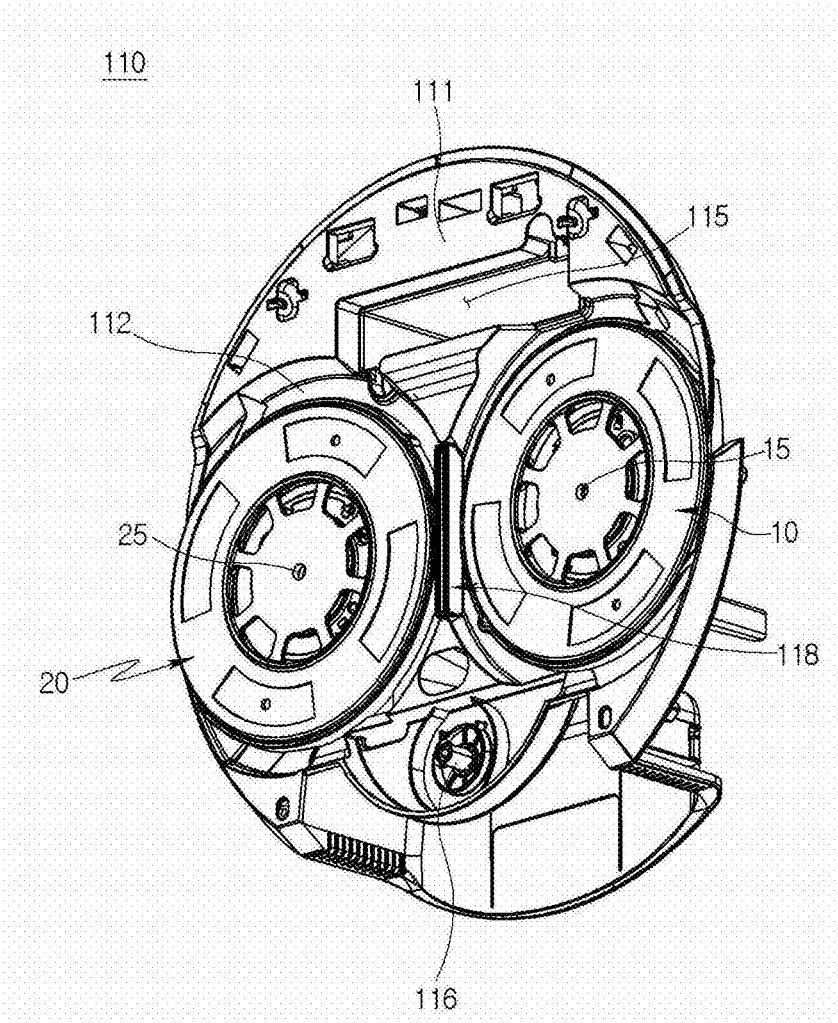
FIG. 8 is a perspective view for explaining a lower body of a robot cleaner according to a first embodiment of the present disclosure.
Figure 9:
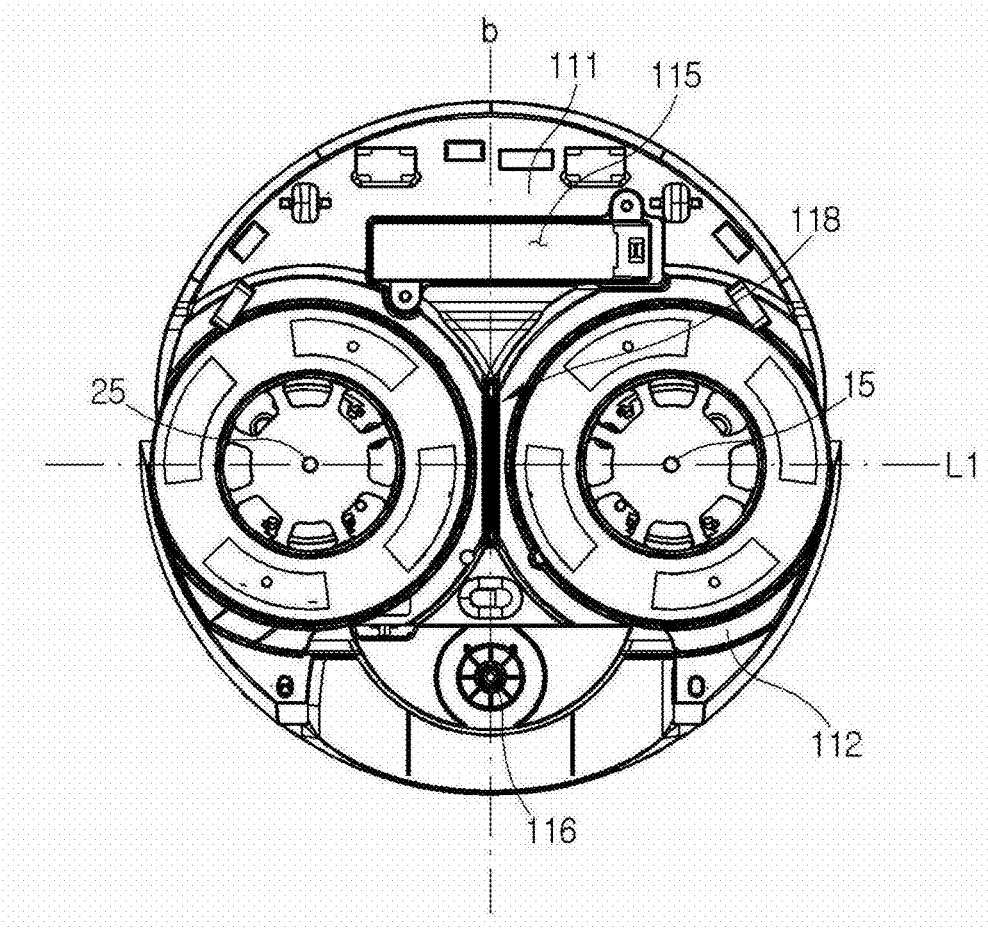
FIG. 9 is a bottom plan view for explaining the lower body of the robot cleaner according to the first embodiment of the present disclosure.
Figure 10:
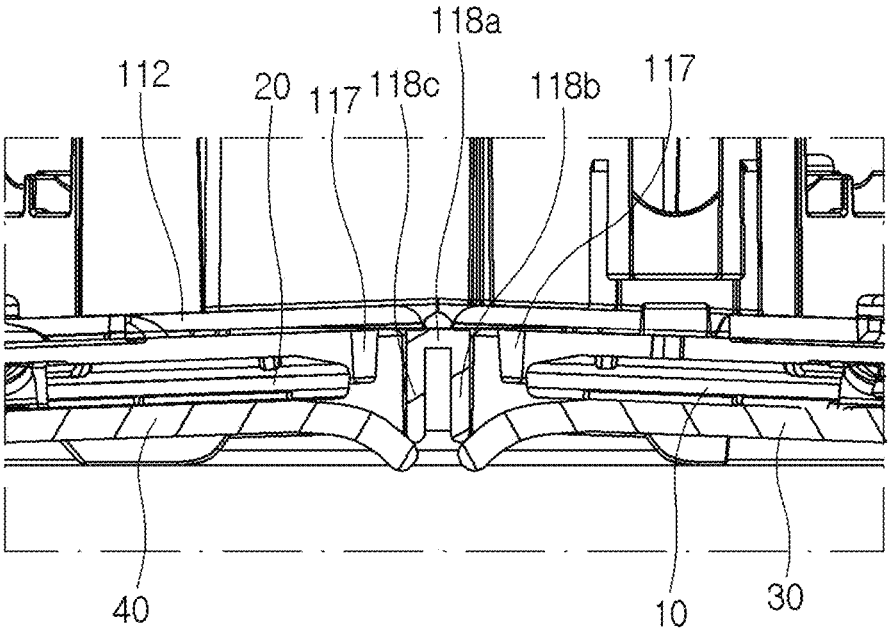
FIG. 10 is a cross-sectional view taken along a connection line for explaining a state in which rotary plates and mops are mounted on the robot cleaner according to the first embodiment of the present disclosure.

Meanwhile, FIG. 8 is a perspective view for explaining the lower body of the robot cleaner according to the first embodiment of the present disclosure, FIG. 9 is a bottom plan view for explaining the lower body of the robot cleaner according to the first embodiment of the present disclosure, and FIG. 10 is a cross-sectional view taken along a connection line for explaining a state in which the rotary plates and the mops are mounted on the robot cleaner according to the first embodiment of the present disclosure.

The lower body 110 of the robot cleaner 1 according to the first embodiment of the present disclosure will be described below with reference to FIGS. 6 and 8 to 10.

An upper surface of the lower body 110 may be coupled to the upper body 105 to define a space that may accommodate the battery 220, the water container 230, and the motors 162 and 172. The first rotary plate 10, the second rotary plate 20, the first support wheel 120, the second support wheel 130, and the auxiliary wheel 140 may be disposed on a lower surface of the lower body 110.

The lower surface of the lower body 110 according to the present disclosure may have the bottom surface 112 disposed to be directed toward the floor surface B of the floor. Further, the first rotary plate 10 and the second rotary plate 20 may be rotatably disposed on the bottom surface 112.

The first rotary plate 10 and the second rotary plate 20 may be symmetrically disposed on the bottom surface 112. Specifically, a first rotary shaft hole 113 and a second rotary shaft hole 114 may be symmetrically formed in the bottom surface 112.

The rotary shaft 15 of the first rotary plate 10 may penetrate the first rotary shaft hole 113 and mesh with the first gear 163 of the first actuator 160. In addition, the rotary shaft of the second rotary plate 20 may penetrate the second rotary shaft hole 114 and mesh with the second gear 173 of the second actuator 170.

Meanwhile, in the present disclosure, the lower body 110 may further include the imaginary connection line L1 connecting the rotary shaft 15 of the first rotary plate 10 and the rotary shaft 25 of the second rotary plate 20. In this case, since the rotary shaft 15 of the first rotary plate 10 and the rotary shaft 25 of the second rotary plate 20 penetrate the first rotary shaft hole 113 and the second rotary shaft hole 114, respectively, the connection line L1 may mean the imaginary line connecting the first rotary shaft hole 113 and the second rotary shaft hole 114.

A distance C2 between the first rotary shaft hole 113 and the second rotary shaft hole 114 may be longer than twice a radius of the first rotary plate 10 or the second rotary plate 20. With this configuration, the first rotary plate 10 and the second rotary plate 20 may rotate without interfering with each other.

In addition, in the present embodiment, the bottom surface 112 may be inclined to become closer to the floor surface B as distances from the first rotary shaft hole 113 and the second rotary shaft hole 114 decrease based on an intermediate point between the first rotary shaft hole 113 and the second rotary shaft hole 114. With this configuration, the portions of the first and second rotary plates 10 and 20, which are distant from each other, may be more strongly in contact with the floor.

The lower body 110 according to the present disclosure may further include a guide surface 111. The guide surface 111 may be disposed at a front side based on the bottom surface 112. In addition, at least a part of the guide surface 111 may be formed to face the floor surface B.

The guide surface 111 may be disposed close to the floor surface B by having a level difference with the bottom surface 112. The first support wheel 120 and the second support wheel 130 may be disposed on the guide surface 111. In addition, a battery accommodation portion 115 may be provided in the guide surface 111.

The battery accommodation portion 115 may accommodate the battery 220. For example, the battery accommodation portion 115 may have a shape similar to a rectangular hole so that the battery 220 may be inserted and coupled to the battery accommodation portion 115. Therefore, the battery 220 may be inserted into the battery accommodation portion 115 and then screw-assembled with and fixed to the body 100.

The lower body 110 may further include an auxiliary wheel accommodation portion 116. The auxiliary wheel accommodation portion 116 may be disposed at a rear side based on the bottom surface 112. In addition, the auxiliary wheel accommodation portion 116 may protrude from the lower surface of the lower body 110 toward the floor surface B. The auxiliary wheel 140 and the auxiliary wheel body 150 may be coupled to the auxiliary wheel accommodation portion 116.

Meanwhile, the lower body 110 may include a centerline b. Specifically, the centerline b may be implemented by drawing an imaginary line which is parallel to the floor surface B and perpendicular to the connection line L1 at the intermediate point between the first rotary shaft hole 113 and the second rotary shaft hole 114.

Further, the battery accommodation portion 115 may be disposed at one side based on the connection line L1, and the auxiliary wheel accommodation portion 116 may be disposed at the other side based on the connection line L1.

In this case, the auxiliary wheel accommodation portion 116 and the battery accommodation portion 115 may be disposed on the centerline b. That is, the centerline b may be an imaginary line which is perpendicular to the connection line L1 and connects the battery accommodation portion 115 and the auxiliary wheel accommodation portion 116.

Therefore, based on the centerline b, the first rotary plate 10 and the second rotary plate 20 may be disposed symmetrically (linearly symmetrically).

In the present embodiment, the lower body 110 may further include foreign substance blocking ribs 117. The foreign substance blocking ribs 117 may protrude downward from the bottom surface 112 and be formed along outer peripheries of the first rotary plate 10 and the second rotary plate 20.

For example, the foreign substance blocking ribs 117 may include: a first foreign substance blocking rib 117*a* protruding in the form of a rib in a circumferential direction around the first rotary shaft hole 113, and a second foreign substance blocking rib 117*b* protruding in the form of a rib in a circumferential direction around the second rotary shaft hole 114.

In this case, a distance d from the first rotary shaft hole 113 to the first foreign substance blocking rib 117*a* may be larger than the radius of the first rotary plate 10 and smaller than the radius of the first mop 30.

In addition, a distance d from the second rotary shaft hole 114 to the second foreign substance blocking rib 117*b* may be larger than the radius of the second rotary plate 20 and smaller than the radius of the second mop 40.

Further, the foreign substance blocking rib 117 may be disposed to be spaced apart from the first rotary plate 10 or the second rotary plate 20 at a predetermined interval. In this case, the interval between the foreign substance blocking rib 117 and the first rotary plate 10 or the second rotary plate 20 may be preferably small within a range in which the foreign substance blocking rib 117 does not interfere with the first rotary plate 10 or the second rotary plate 20 when the first rotary plate 10 or the second rotary plate 20 rotates.

With this configuration, the robot cleaner 1 according to the present disclosure may prevent foreign substances including hair and dust on the floor from entering the robot cleaner 1 even when the first rotary plate 10 and the second rotary plate 20 rotate.

Meanwhile, although not illustrated, according to the embodiment, the robot cleaner 1 may further include one or more additional foreign substance blocking structures between the first rotary shaft hole 113 and the first foreign substance blocking rib 117*a*. In addition, one or more additional foreign substance blocking structures may be further provided between the second rotary shaft hole 114 and the second foreign substance blocking rib 117*b*. This configuration may prevent foreign substances from entering the robot cleaner 1.

The lower body 110 according to the embodiment of the present disclosure may further include the mop support portion 118.

The mop support portion 118 may be disposed on the bottom surface. Specifically, the mop support portion 118 may be disposed between the first rotary plate 10 and the second rotary plate 20. More specifically, the mop support portion 118 may be disposed on the connection line L1 and may be disposed on the centerline b. That is, the mop support portion 118 may be disposed on the intersection point between the connection line L1 and the centerline b.

In this case, a distance from the first rotary shaft hole 113 to the mop support portion 118 may be larger than the radius of the first rotary plate 10, and a distance from the second rotary shaft hole 114 to the mop support portion 118 may be larger than the radius of the second rotary plate 20.

Further, a distance from the first rotary shaft hole 113 to the mop support portion 118 may be smaller than the radius of the first mop 30, and a distance from the second rotary shaft hole 114 to the mop support portion 118 may be smaller than the radius of the second mop 40.

That is, the first mop 30 may protrude toward the center of the robot cleaner 1 further than the first rotary plate 10, the second mop 40 may protrude toward the center of the robot cleaner 1 further than the second rotary plate 20, and the mop support portion 118 may be disposed above the protruding portions of the first and second mops 30 and 40.

The mop support portion 118 according to the present embodiment may include a coupling surface 118*a*, a first mop support surface 118*b*, and a second mop support surface 118*c*.

The coupling surface 118*a* may be coupled to the bottom surface 112. For example, the coupling surface 118*a* may be formed in a rectangular flat plate shape and fixedly coupled to the bottom surface.

Meanwhile, the coupling surface 118*a* may be disposed to be elongated in the direction perpendicular to the connection line L1. That is, the coupling surface 118*a* may be disposed to be elongated along the centerline b.

The first mop support surface 118*b* and the second mop support surface 118*c* may be bent and extend downward from the coupling surface 118*a*. For example, the first mop support surface 118*b* and the second mop support surface 118*c* may be disposed in parallel with each other. In addition, as another example, the first mop support surface 118*b* and the second mop support surface 118*c* may be inclined at a predetermined angle with respect to the coupling surface 118*a*.

Meanwhile, the extension length of each of the first mop support surface 118*b* and the second mop support surface 118*c* may be larger than a height from the bottom surface 112 to the lower surface of the first rotary plate 10 or the second rotary plate 20.

Further, the first mop support surface 118*b* or the second mop support surface 118*c* may be disposed to be perpendicular to the connection line L1. In addition, the first mop support surface 118*b* or the second mop support surface 118*c* may be disposed to be elongated in the direction parallel to the centerline b.

With this configuration, the first mop 30 may be in contact with the first mop support surface 118*b*, and the second mop 40 may be in contact with the second mop support surface 118*c*. Therefore, since the first mop 30 and the second mop 40 are in contact with the first mop support surface 118*b* and second mop support surface 118*c*, respectively, the area in which the friction is generated with the floor.

In addition, the first mop 30 and the second mop 40 are pushed against the floor by the first mop support surface 118*b* and the second mop support surface 118*c*, which may increase the frictional force between the mops 30 and 40 and the floor.

That is, when the robot cleaner 1 is placed on the floor surface B in the state in which the mops 30 and 40 are attached to the rotary plates 10 and 20, at least a part of the lower surface of the first mop 30 and at least a part of the lower surface of the second mop 40 may be in contact with the floor surface B. Further, the upper surfaces of the mops 30 and 40 may be attached to the lower surfaces of the rotary plates 10 and 20.

Further, a part of the upper surface of each of the mops 30 and 40 and a part of the lower surface of each of the rotary plates 10 and 20 may be close to each other by the weight of the body 100.

Meanwhile, the portions of the upper surfaces of the mops 30 and 40, which are in contact with the mop support portions 118, may be distant from the lower surfaces of the rotary plates 10 and 20.

Therefore, when the rotary plates 10 and 20 rotate, the distances between the mops and 40 and the rotary plates 10 and 20 and the distances between the mops 30 and 40 and the floor surface B may be changed periodically.

Specifically, when the rotary plates 10 and 20 rotate in the state in which the mops 30 and 40 are attached to the rotary plates 10 and 20, a distance between a part of the upper surface of each of the mops 30 and 40 and a part of the lower surface of each of the rotary plates 10 and 20 may be changed periodically as the rotary plates 10 and 20 rotate. In addition, a distance between the floor surface B and a part of the lower surface of each of the mops 30 and 40 may be changed periodically.

As a result, according to the present disclosure, the increase in frictional force between the floor and the mops 30 and 40 may improve the cleaning performance of the central portion of the robot cleaner 1.

Figure 11:
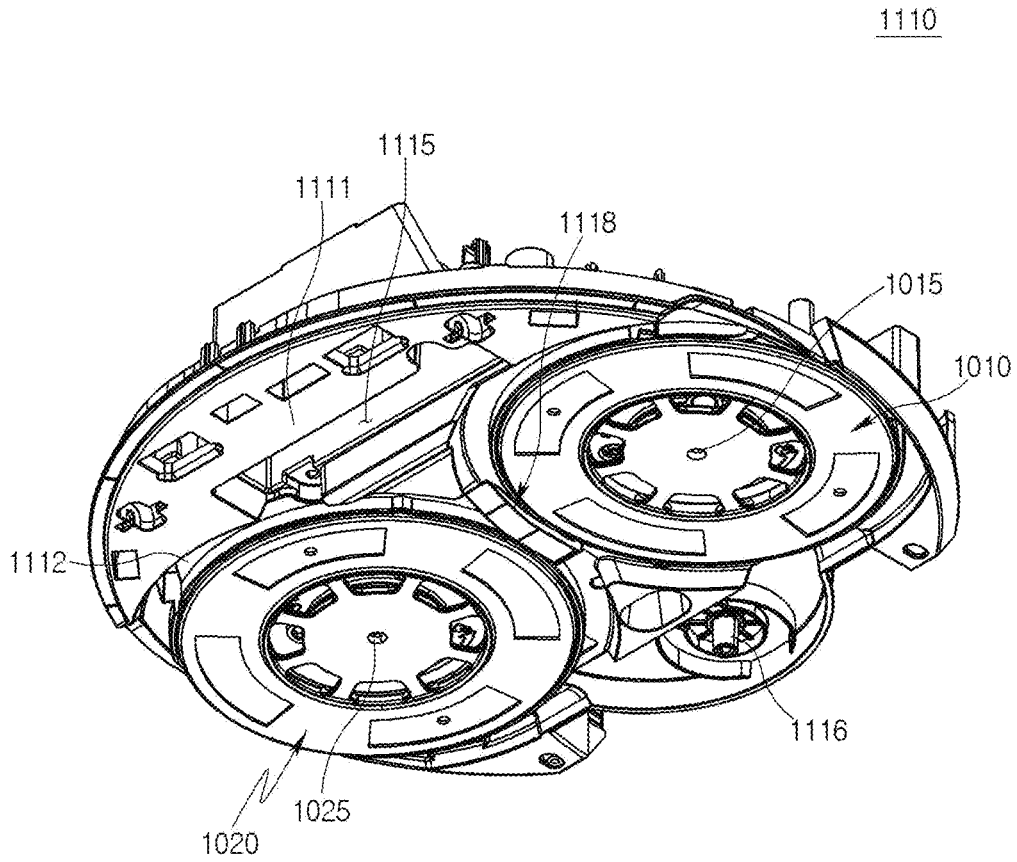
FIG. 11 is a perspective view for explaining a lower body of a robot cleaner according to a second embodiment of the present disclosure.
Figure 12:
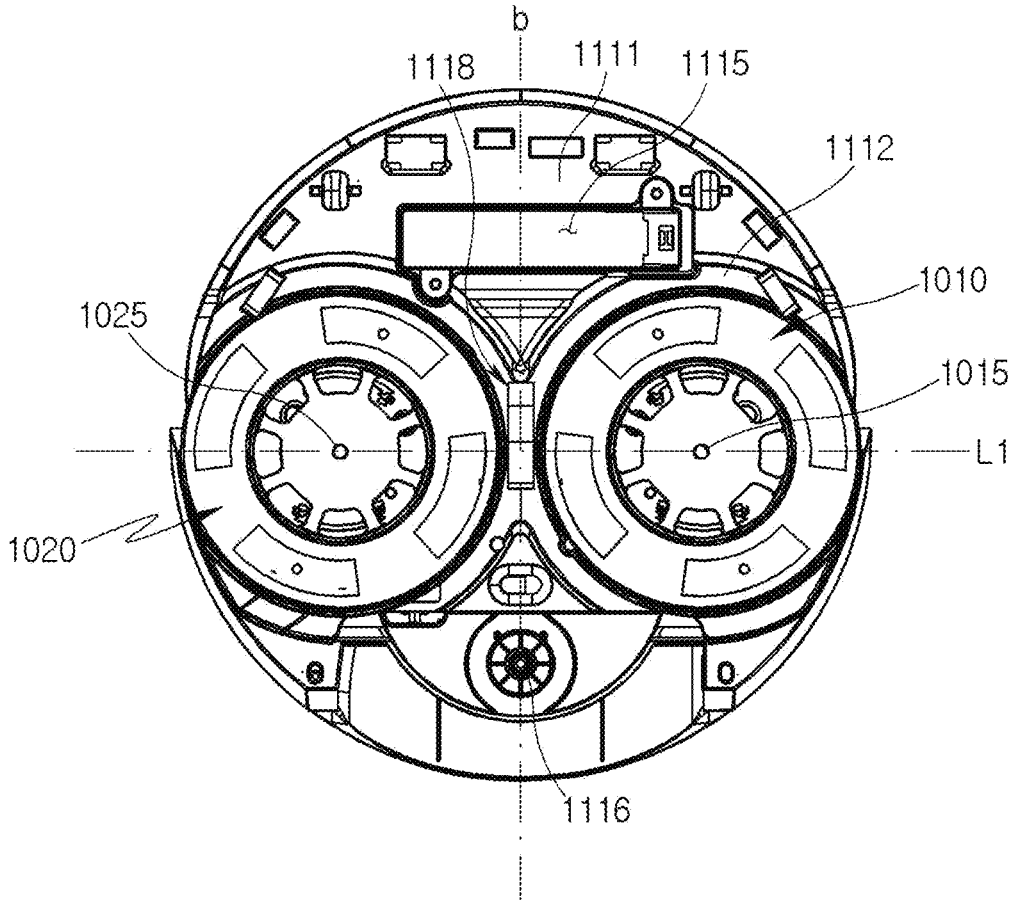
FIG. 12 is a bottom plan view for explaining the lower body of the robot cleaner according to the second embodiment of the present disclosure.
Figure 13:
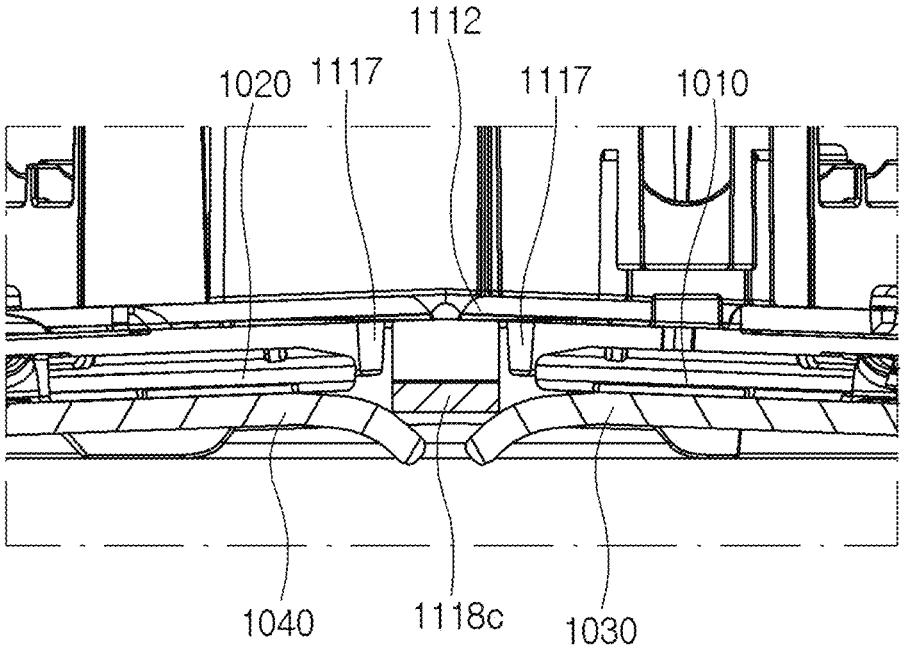
FIG. 13 is a cross-sectional view taken along a connection line for explaining a state in which rotary plates and mops are mounted on the robot cleaner according to the second embodiment of the present disclosure.
Figure 14:
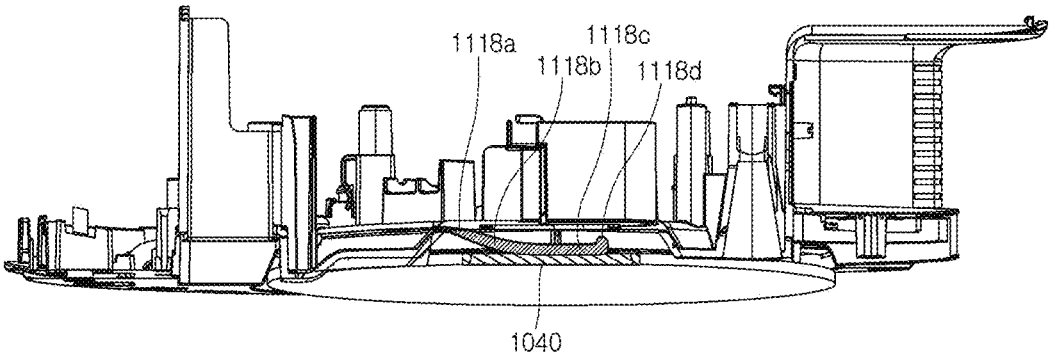
FIG. 14 is a cross-sectional view taken along a centerline for explaining a state in which rotary plates and mops are mounted on the robot cleaner according to the second embodiment of the present disclosure.

FIG. 11 is a perspective view for explaining a lower body of a robot cleaner according to a second embodiment of the present disclosure, FIG. 12 is a bottom plan view for explaining the lower body of the robot cleaner according to the second embodiment of the present disclosure, FIG. 13 is a cross-sectional view taken along a connection line for explaining a state in which rotary plates and mops are mounted on the robot cleaner according to the second embodiment of the present disclosure, FIG. 14 is a cross-sectional view taken along a centerline for explaining a state in which rotary plates and mops are mounted on the robot cleaner according to the second embodiment of the present disclosure.

The robot cleaner 1 according to the second embodiment of the present disclosure will be described below with reference to FIGS. 11 to 14.

Meanwhile, in order to avoid the repeated description, the description of the robot cleaner 1 according to the first embodiment of the present disclosure may be applied except for the components particularly described in the present embodiment.

In the present embodiment, a mop support portion 1118 may include an extension portion 1118*a*, a connection surface 1118*b*, a contact support surface 1118*c*, and a guide protrusion 1118*d*.

In this case, the mop support portion 1118 may be disposed to be elongated in the direction perpendicular to the connection line L1. That is, the mop support portion 1118 may be disposed to be elongated along the centerline b.

The extension portion 1118*a* may extend and protrude by a predetermined angle downward from a bottom surface 1112.

The extension portion 1118*a* may be disposed on the centerline b. For example, the extension portion 1118*a* may be disposed between the connection line L1 and a battery accommodation portion 1115.

The connection surface 1118*b* may extend from the extension portion 1118*a* to connect the extension portion 1118*a* and the contact support surface 1118*c*. In this case, the connection surface 1118*b* may extend from the extension portion 1118*a* along the centerline b. That is, the connection surface 1118*b* may extend from the extension portion 1118*a* toward the auxiliary wheel accommodation portion 116. Therefore, the extension direction of the connection surface 1118*b* may be perpendicular to the connection line L1.

The contact support surface 1118*c* may extend along the centerline b from the connection surface 1118*b* and may be in contact with the first mop 1030 and the second mop 1040. For example, the contact support surface 1118*c* may have a flat plate shape, the first mop 1030 may be in contact with one side of the contact support surface 1118*c* in the direction perpendicular to the extension direction, and the second mop 1040 may be in contact with the other side of the contact support surface 1118*c*.

The contact support surface 1118*c* may extend along the centerline b from the connection surface 1118*b*. In this case, the contact support surface 1118*c* may be disposed on the connection line L1.

A height from the bottom surface 1112 to the lower surface of the contact support surface 1118*c* may be larger than a height from the bottom surface 1112 to a first rotary plate 1010 or a second rotary plate 1020.

With this configuration, the mop support portion 1118 may be similar to a kind of cantilevered beam and elastically support the first mop 1030 and the second mop 1040. That is, the extension portion 1118*a* may serve as a fixed end, and the contact support surface 1118*c* may serve as a free end, such that the mop support portion 1118 may be in contact with and elastically support the first mop 1030 and the second mop 1040.

The guide protrusion 1118*d* may extend and protrude toward the bottom surface 1112 from an upper surface of the contact support surface 1118*c*.

With this configuration, the mop support portion 1118 may maintain an elastic supporting force of the mop support portion 1118 regardless of the rotation directions of the first and second mops 1030 and 1040. That is, the guide protrusion 1118*d* may prevent the first mop 1030 or the second mop 1040 from being rotated and caught in the space provided between the bottom surface 1112 and the contact support surface 1118*c*.

Therefore, according to the present embodiment, the mop support portion 1118 elastically supports the first mop 1030 and the second mop 1040. Therefore, even when the first mop 1030 or the second mop 1040 strongly pushes the mop support portion 1118, the mop support portion 1118 may maintain a predetermined supporting force by being elastically deformed. Therefore, according to the present embodiment, the mop support portion 1118 may constantly maintain the cleaning force of the central portion of the robot cleaner 1.

Figure 15:
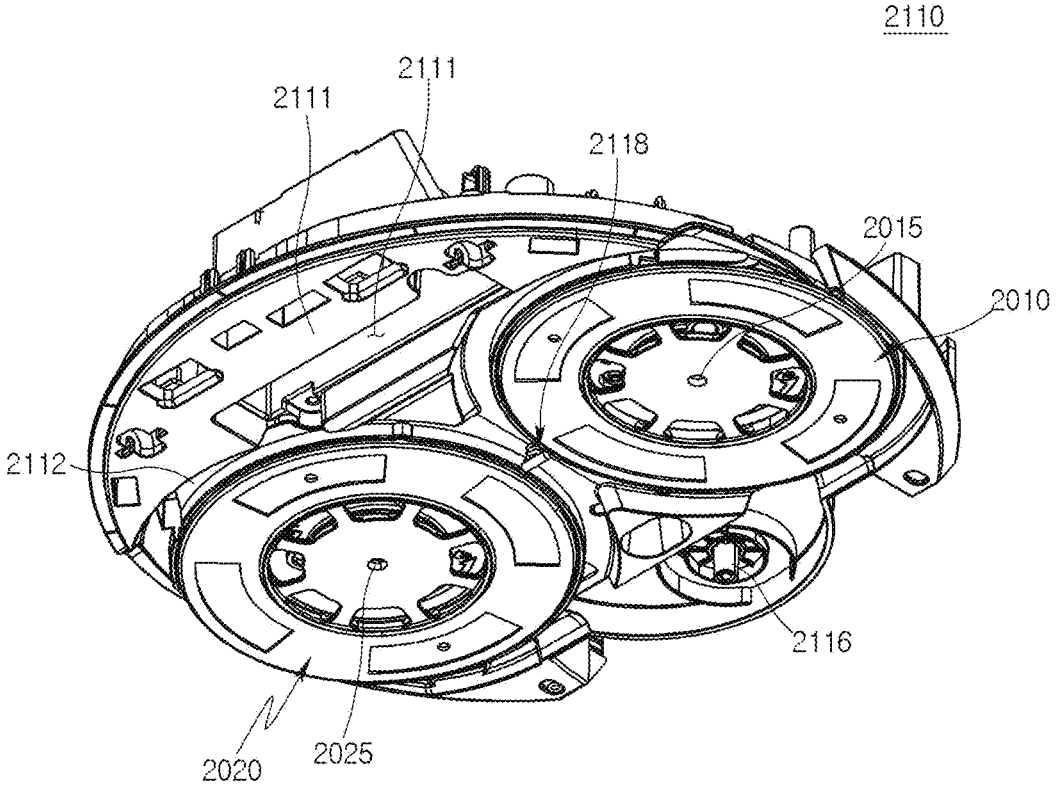
FIG. 15 is a perspective view for explaining a lower body of a robot cleaner according to a third embodiment of the present disclosure.
Figure 16:
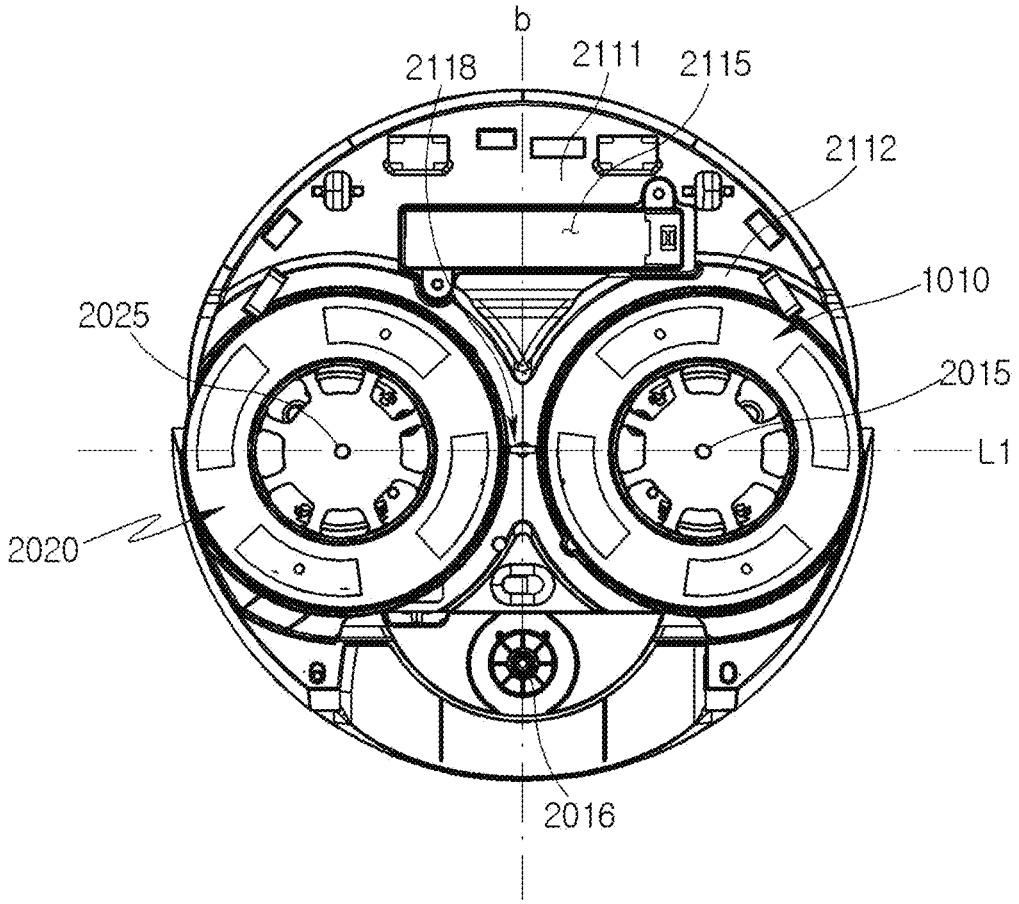
FIG. 16 is a bottom plan view for explaining the lower body of the robot cleaner according to the third embodiment of the present disclosure.
Figure 17:
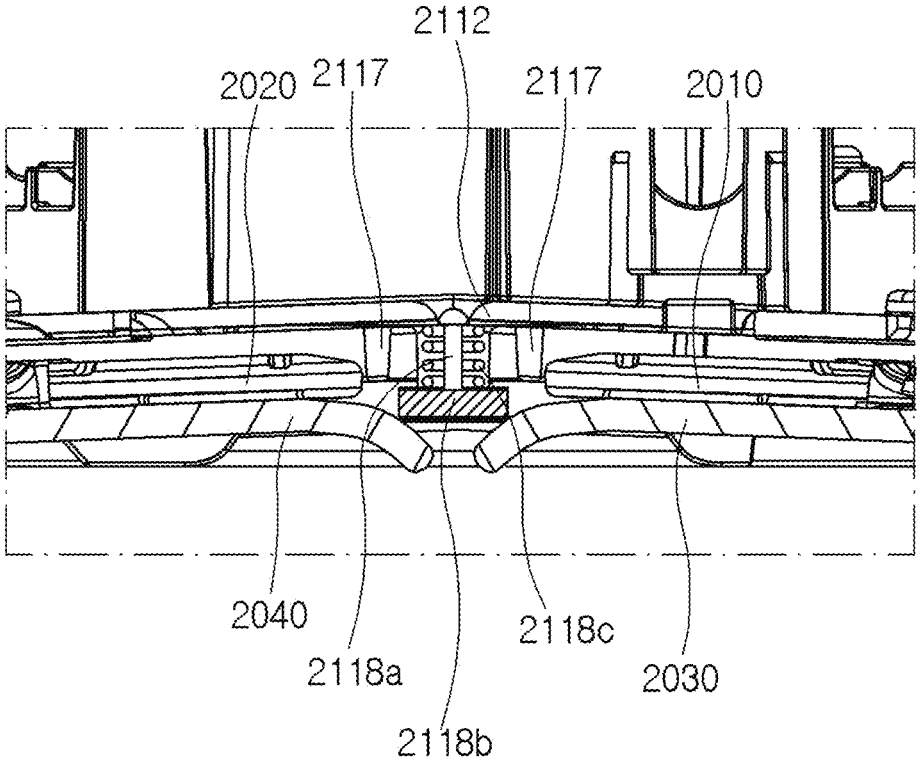
FIG. 17 is a cross-sectional view taken along a connection line for explaining a state in which rotary plates and mops are mounted on the robot cleaner according to the third embodiment of the present disclosure.

FIG. 15 is a perspective view for explaining a lower body of a robot cleaner according to a third embodiment of the present disclosure, FIG. 16 is a bottom plan view for explaining the lower body of the robot cleaner according to the third embodiment of the present disclosure, and FIG. 17 is a cross-sectional view taken along a connection line for explaining a state in which rotary plates and mops are mounted on the robot cleaner according to the third embodiment of the present disclosure.

The robot cleaner 1 according to the third embodiment of the present disclosure will be described below with reference to FIGS. 15 to 17.

Meanwhile, in order to avoid the repeated description, the description of the robot cleaner 1 according to the first embodiment of the present disclosure may be applied except for the components particularly described in the present embodiment.

In the present embodiment, a mop support portion 2118 may include a guide bar 2118*a*, a support bar 2118*b*, and a spring 2118*c*.

The guide bar 2118*a* may be disposed to protrude downward from a bottom surface 2112. For example, the guide bar 2118*a* may protrude downward from the bottom surface 2112 and may be fixedly coupled to the bottom surface 2112.

The guide bar 2118*a* may be disposed at an intermediate position between the first rotary shaft hole 2113 and the second rotary shaft hole 2114. That is, the guide bar 2118*a* may be disposed on the imaginary connection line L1. In addition, the guide bar 2118*a* may be disposed on the centerline b. Therefore, the guide bar 2118*a* may be disposed at a point at which the connection line L1 and the centerline b intersect.

With this configuration, the mop support portion 2118 may be disposed at a position at which the cleaning force of the robot cleaner 1 may be lowered, thereby improving the cleaning force.

The guide bar 2118*a* may be provided to support the support bar 2118*b*. For example, the guide bar 2118*a* may have a cylindrical shape. In addition, the guide bar 2118*a* may have a polygonal column shape.

Although not illustrated, a guide rib or a guide groove may be formed in an axial direction on an outer circumferential surface of the guide bar 2118*a* to guide a vertical movement of the support bar 2118*b* and prevent a rotation of the support bar 2118*b*.

The support bar 2118*b* may be coupled to the guide bar 2118*a* and be in contact with a first mop 2030 and a second mop 2040.

The support bar 2118*b* may include a curved surface that is in contact with the first mop 2030 and the second mop 2040. For example, the support bar 2118*b* may have a cylindrical shape having an axis parallel to the connection line L1.

With this configuration, it is possible to prevent damage caused by friction even when the first mop 2030 and the second mop 2040 come into contact with the support bar 2118*b* while rotating.

The support bar 2118*b* may be coupled to the guide bar 2118*a* so as to be movable in the vertical direction along the guide bar 2118*a*. For example, a hole into which the guide bar 2118*a* is inserted and coupled may be formed at an intermediate point in the axial direction of the support bar 2118*b*.

The spring 2118*c* may elastically support the support bar 2118*b*. For example, the spring 2118*c* may be a coil spring, and the guide bar 2118*a* may penetrate the spring 2118*c* and be disposed in the spring 2118*c*.

Therefore, according to the present embodiment, the mop support portion 2118 elastically supports the first mop 2030 and the second mop 2040. Therefore, even when the first mop 2030 or the second mop 2040 strongly pushes the mop support portion 2118, the mop support portion 2118 may maintain a predetermined supporting force as the mop support portion 2118 is moved vertically by the spring 2118*c*. Therefore, according to the present embodiment, the mop support portion 2118 may constantly maintain the cleaning force of the central portion of the robot cleaner 1.

Figure 18:
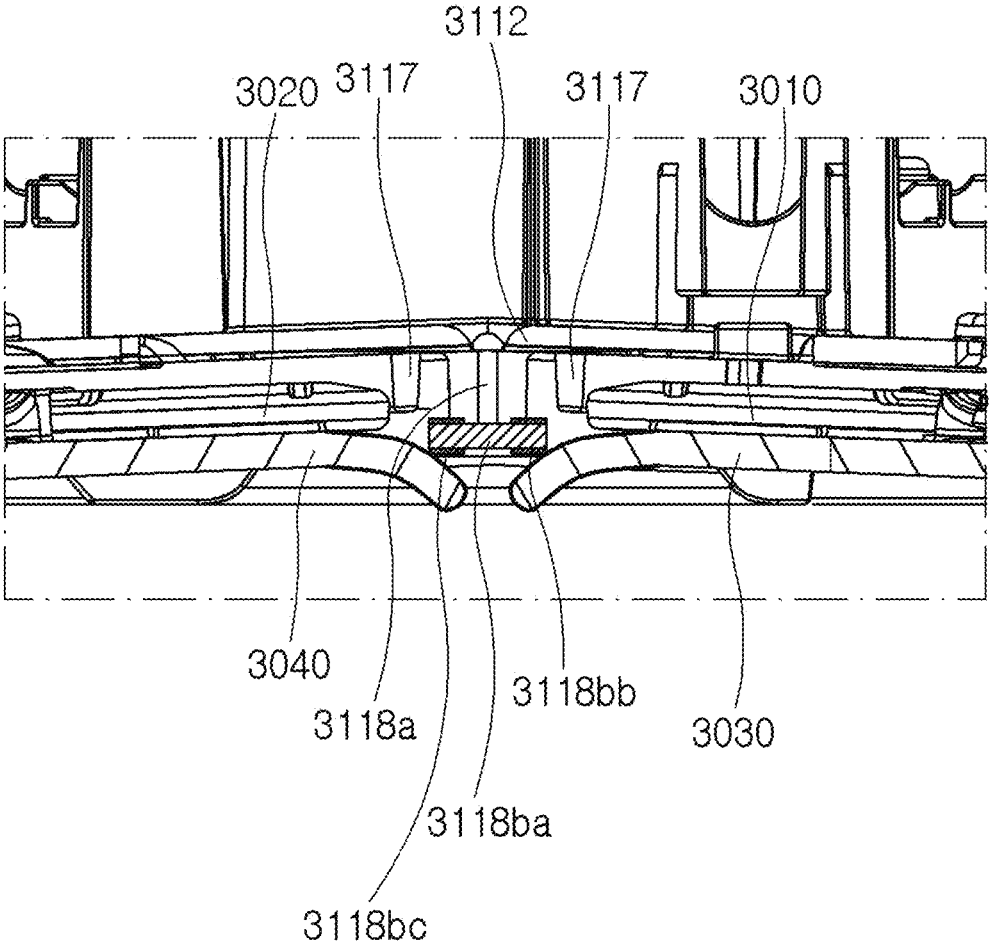
FIG. 18 is a cross-sectional view taken along a connection line for explaining a state in which rotary plates and mops are mounted on a robot cleaner according to a fourth embodiment of the present disclosure.

Meanwhile, FIG. 18 is a cross-sectional view taken along a connection line for explaining a state in which rotary plates and mops are mounted on a robot cleaner according to a fourth embodiment of the present disclosure.

The robot cleaner 1 according to the fourth embodiment of the present disclosure will be described with reference to FIG. 18.

Meanwhile, in order to avoid the repeated description, the description of the robot cleaner 1 according to the first embodiment of the present disclosure may be applied except for the components particularly described in the present embodiment.

In the present embodiment, a mop support portion 3118 may include a guide bar 3118*a* and a support roller 3118*b*.

The guide bar 3118*a* may be disposed to protrude downward from a bottom surface 3112. For example, the guide bar 3118*a* may protrude downward from the bottom surface 3112 and may be fixedly coupled to the bottom surface 3112.

The guide bar 3118*a* may be disposed at an intermediate position between the first rotary shaft hole 3113 and the second rotary shaft hole 3114. That is, the guide bar 3118*a* may be disposed on the imaginary connection line L1. In addition, the guide bar 3118*a* may be disposed on the centerline b. Therefore, the guide bar 3118*a* may be disposed at a point at which the connection line L1 and the centerline b intersect.

With this configuration, the mop support portion 3118 may be disposed at a position at which the cleaning force of the robot cleaner 1 may be lowered, thereby improving the cleaning force.

The guide bar 3118*a* may be provided to support the support roller 3118*b*. For example, the guide bar 3118*a* may have a cylindrical shape. In addition, the guide bar 3118*a* may have a polygonal column shape.

The support roller 3118*b* may be coupled to the guide bar 3118*a* and be in contact with the first mop 3030 and the second mop 3040.

The support roller 3118*b* may include a roller shaft 3118*ba*, a first roller 3118*bb*, and a second roller 3118*bc*.

The roller shaft 3118*ba* may be fixedly coupled to the guide bar 3118*a*.

Meanwhile, as another embodiment, the roller shaft 3118*ba* may be coupled to be movable in the vertical direction along the guide bar 3118*a*. That is, a long hole or a rail is provided on the guide bar 3118*a*, and the roller shaft 3118*ba* is penetratively inserted and coupled to the long hole or the rail of the guide bar 3118*a*, such that the roller shaft 3118*ba* may move vertically along the guide bar 3118*a*.

The roller shaft 3118*ba* may be disposed in parallel with the connection line L1. That is, the roller shaft 3118*ba* may be provided in the form of a rod along the connection line L1. In this case, the guide bar 3118*a* may be coupled to an intermediate point in the axial direction of the roller shaft 3118*ba*. The first roller 3118*bb* may be coupled to one side in the axial direction of the roller shaft 3118*ba* based on the intermediate point coupled to the guide bar 3118*a*, and the second roller 3118*bc* may be coupled to the other side in the axial direction of the roller shaft 3118*ba*.

The first roller 3118*bb* may be rotatably coupled to the roller shaft 3118*ba* and be in contact with the first mop 3030. In addition, the second roller 3118*bc* may be rotatably coupled to the roller shaft 3118*ba* and be in contact with the second mop 3040.

With this configuration, when the first mop 3030 rotates, the first roller 3118*bb* may come into contact with the first mop 3030 and rotate in conjunction with the rotation of the first mop 3030. In addition, when the second mop 3040 rotates, the second roller 3118*bc* may come into contact with the second mop 3040 and rotate in conjunction with the rotation of the second mop 3040.

Therefore, the first roller 3118*bb* and the second roller 3118*bc* may independently rotate. With this configuration, the first roller 3118*bb* and the second roller 3118*bc* may rotate regardless of the rotation directions of the first and second mops 3030 and 3040 and a difference in rotational speed between the first mop 3030 and the second mop 3040.

According to the present embodiment, the first actuator 160 and the second actuator 170 are separately controlled. Even when the rotation directions and the rotational speeds of the first and second mops 3030 and 3040 are changed, it is possible to support the stably first mop 3030 and the second mop 3040, thereby improving the cleaning force of the central portion of the robot cleaner 1.

Figure 19:
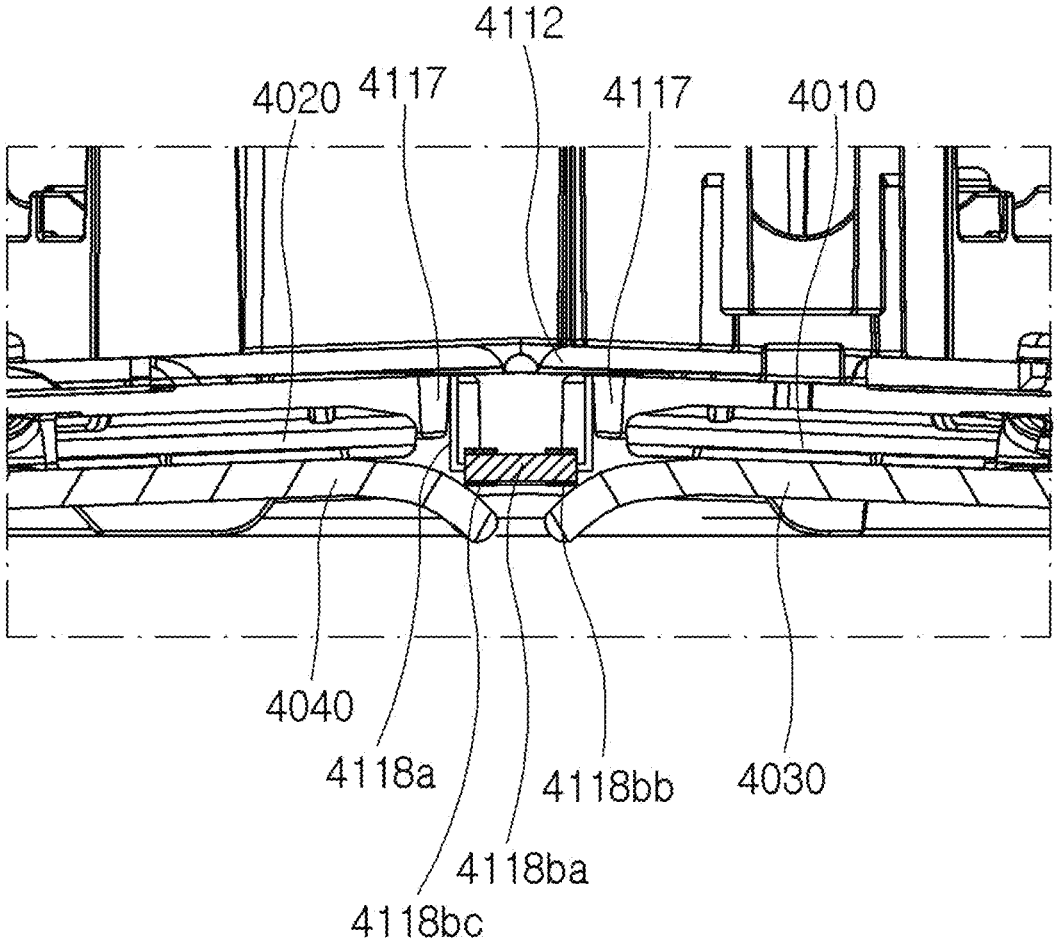
FIG. 19 is a cross-sectional view taken along a connection line for explaining a state in which rotary plates and mops are mounted on a robot cleaner according to a fifth embodiment of the present disclosure.

Meanwhile, FIG. 19 is a cross-sectional view taken along a connection line for explaining a state in which rotary plates and mops are mounted on a robot cleaner according to a fifth embodiment of the present disclosure.

The robot cleaner 1 according to the fifth embodiment of the present disclosure will be described with reference to FIG. 19.

Meanwhile, in order to avoid the repeated description, the description of the robot cleaner 1 according to the first embodiment of the present disclosure may be applied except for the components particularly described in the present embodiment.

In the present embodiment, a mop support portion 4118 may include guide bars 4118*a* and a support roller 4118*b*.

The guide bar 4118*a* may be disposed to protrude downward from a bottom surface 4112. For example, the guide bar 4118*a* may protrude downward from the bottom surface 4112 and may be fixedly coupled to the bottom surface 4112.

The guide bar 4118*a* may be disposed on the imaginary connection line L1.

For example, the two guide bars 4118*a* may be disposed on the imaginary connection line L1, and the pair of guide bars 4118*a* may be disposed symmetrically with respect to the centerline b.

With this configuration, the mop support portion 4118 may be disposed at a position at which the cleaning force of the robot cleaner 1 may be lowered, thereby improving the cleaning force.

The guide bars 4118*a* may be provided to support the support roller 4118*b*. For example, the guide bar 4118*a* may have a cylindrical shape.

The support roller 4118*b* may be coupled to the guide bars 4118*a* and be in contact with the first mop 4030 and the second mop 4040.

The support roller 4118*b* may include a roller shaft 4118*ba*, a first roller 4118*bb*, and a second roller 4118*bc*.

The roller shaft 4118*ba* may be fixedly coupled to the guide bars 4118*a*. For example, two opposite ends in the axial direction of the roller shaft 4118*ba* may be fixedly coupled to the pair of guide bars 4118*a*.

The roller shaft 4118*ba* may be disposed in parallel with the connection line L1. That is, the roller shaft 4118*ba* may be provided in the form of a rod along the connection line L1. In this case, the first roller 4118*bb* may be coupled to one side in the axial direction of the roller shaft 4118*ba*, and the second roller 4118*bc* may be coupled to the other side in the axial direction of the roller shaft 4118*ba*.

The first roller 4118*bb* may be rotatably coupled to the roller shaft 4118*ba* and be in contact with the first mop 4030. In addition, the second roller 4118*bc* may be rotatably coupled to the roller shaft 4118*ba* and be in contact with the second mop 4040.

With this configuration, when the first mop 4030 rotates, the first roller 4118*bb* may come into contact with the first mop 4030 and rotate in conjunction with the rotation of the first mop 4030. In addition, when the second mop 4040 rotates, the second roller 4118*bc* may come into contact with the second mop 4040 and rotate in conjunction with the rotation of the second mop 4040.

Therefore, the first roller 4118*bb* and the second roller 4118*bc* may independently rotate. With this configuration, the first roller 4118*bb* and the second roller 4118*bc* may rotate regardless of the rotation directions of the first and second mops 4030 and 4040 and a difference in rotational speed between the first mop 4030 and the second mop 4040.

According to the present embodiment, the first actuator 160 and the second actuator 170 are separately controlled. Even when the rotation directions and the rotational speeds of the first and second mops 4030 and 4040 are changed, it is possible to support the stably first mop 4030 and the second mop 4040, thereby improving the cleaning force of the central portion of the robot cleaner 1.

Further, in the present embodiment, the pair of guide bars 4118*a* is provided to support the two opposite sides in the axial direction of the roller shaft 4118*ba*, thereby improving durability.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A robot cleaner comprising:

a body;

a first rotary plate having a lower surface to which a first mop facing a floor surface is coupled, the first rotary plate being rotatably provided at a bottom surface of the body, the bottom surface of the body being directed toward the floor surface; and a second rotary plate having a lower surface to which a second mop facing the floor surface is coupled, the second rotary plate being rotatably provided at the bottom surface of the body, wherein the body comprises:

a mop support provided on the bottom surface and configured to be in contact with and to support the first mop and the second mop, wherein the mop support comprises:

a coupling surface coupled to the bottom surface;

a first mop support surface extending downward from the coupling surface and configured to be in contact with the first mop; and a second mop support surface extending downward from the coupling surface and configured to be in contact with the second mop.

2. The robot cleaner of claim 1, wherein at least one of the first mop support surface or the second mop support surface extends perpendicular to a connection line connecting a rotary shaft of the first rotary plate and a rotary shaft of the second rotary plate.

3. The robot cleaner of claim 1, wherein the mop support is provided on a centerline extending between the first rotary plate and the second rotary plate, and the first rotary plate and the second rotary plate are provided symmetrically with respect to the centerline.

4. The robot cleaner of claim 1, wherein the mop support comprises:

an extension extending by a predetermined angle downward from the bottom surface;

a contact support surface configured to be in contact with the first mop and the second mop; and a connection surface configured to connect the extension and the contact support surface.

5. The robot cleaner of claim 4, wherein the body further comprises:

a battery accommodation cavity positioned at a first side of a connection line connecting a rotary shaft of the first rotary plate and a rotary shaft of the second rotary plate, the battery accommodation cavity being configured to accommodate a battery; and an auxiliary wheel provided at a second side of the connection line, wherein the extension is positioned between the connection line and the battery accommodation cavity, and wherein the connection surface extends from the extension along a centerline extending perpendicular to the connection line and connecting the battery accommodation cavity and the auxiliary wheel.

6. The robot cleaner of claim 4, wherein the mop support further comprises a guide protrusion protruding and extending from the contact support surface toward the bottom surface.

7. The robot cleaner of claim 1, wherein the mop support comprises:

a guide bar provided on and protruding downward from the bottom surface; and a support bar coupled to be movable along the guide bar and configured to be in contact with the first mop and the second mop.

8. The robot cleaner of claim 7, wherein the mop support further comprises a spring configured to elastically support the support bar.

9. The robot cleaner of claim 7, wherein the support bar is positioned on a connection line connecting a rotary shaft of the first rotary plate and a rotary shaft of the second rotary plate.

10. The robot cleaner of claim 1, wherein the mop support comprises:

at least one guide bar protruding downward from the bottom surface; and a support roller coupled to a distal end of the at least one guide bar and configured to be in contact with the first mop and the second mop.

11. The robot cleaner of claim 10, wherein the support roller comprises:

a roller shaft coupled to the at least one guide bar;

a first roller coupled to the roller shaft and configured to be in contact with the first mop; and a second roller coupled to the roller shaft and configured to be in contact with the second mop.

12. The robot cleaner of claim 11, wherein the roller shaft extends in a direction parallel to connection line connecting a rotary shaft of the first rotary plate and a rotary shaft of the second rotary plate.

13. The robot cleaner of claim 1, wherein the body includes a lower body and an upper body coupled to the lower body, and the mop support is provided on the lower body.

14. The robot cleaner of claim 1, wherein the body defines a space to accommodate a battery, a liquid container, and a motor therein.

15. The robot cleaner of claim 1, wherein a first distance between a rotary shaft of the first rotary plate and the mop support is greater than a radius of the first rotary plate, and a second distance between a rotary shaft of the second rotary plate and the mop support is greater than a radius of the second rotary plate.

16. The robot cleaner of claim 15, wherein the first distance between the rotary shaft of the first rotary plate and the mop support is less than a radius of the first mop, and the second distance between the rotary shaft of the second rotary plate and the mop support is less than a radius of the second mop.

17. The robot cleaner of claim 1, wherein the first mop and the second mop protrude farther downward along a centerline of the body in a front-to-rear direction than along lateral side surfaces of the body.

* * * * *